US006501012B1

(12) United States Patent
Toba et al.

(10) Patent No.: US 6,501,012 B1
(45) Date of Patent: Dec. 31, 2002

(54) MUSICAL APPARATUS USING MULTIPLE LIGHT BEAMS TO CONTROL MUSICAL TONE SIGNALS

(75) Inventors: Yoshihiro Toba, Osaka (JP); Shigeru Takahashi, Osaka (JP)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/703,779

(22) Filed: Oct. 31, 2000

Related U.S. Application Data

(63) Continuation of application No. 09/421,906, filed on Oct. 20, 1999, now Pat. No. 6,153,822, which is a continuation of application No. 09/209,400, filed on Dec. 10, 1998, now Pat. No. 5,998,727.

(30) Foreign Application Priority Data

Dec. 11, 1997 (JP) ..... 9-362074

(51) Int. Cl.[7] ..... G10H 3/02
(52) U.S. Cl. ..... 84/724; 341/31
(58) Field of Search ..... 84/723, 724; 341/31

(56) References Cited

U.S. PATENT DOCUMENTS

| | | | | |
|---|---|---|---|---|
| 3,405,222 | A | 10/1968 | Heinzl | |
| 4,321,463 | A | 3/1982 | Stecher | 84/724 X |
| 4,468,999 | A | 9/1984 | Bonanno | |
| 5,045,687 | A | 9/1991 | Gurner | 250/221 |
| 5,237,126 | A | 8/1993 | Curtis et al. | 84/724 |
| 5,369,270 | A | 11/1994 | Gurner et al. | 250/221 |
| 5,414,256 | A | 5/1995 | Gurner et al. | 250/221 |
| 5,442,168 | A | 8/1995 | Gurner et al. | 250/221 |
| 5,459,312 | A | 10/1995 | Gurner et al. | 250/221 |
| 5,473,461 | A | 12/1995 | Miremadi | 359/189 |
| 5,475,214 | A | 12/1995 | DeFranco et al. | 250/221 |
| 5,508,511 | A | 4/1996 | Zur et al. | 250/222.1 |
| 5,833,549 | A | 11/1998 | Zur et al. | 473/199 |

FOREIGN PATENT DOCUMENTS

| | | |
|---|---|---|
| JP | Shou 58-195296 | 12/1983 |
| JP | 7-98583 | 4/1995 |
| JP | Hei 9-269776 | 10/1997 |

OTHER PUBLICATIONS

Interactive Light Press Release, "Interactive Light Launches Revolutionary Music Control Device at Namm '96", Jan. 18, 1996, (2 pages).

Interactive Light Brochure, "Company Background", (2 pages).

1996 Recording Studio Directory, excerpt from Chicagoland's Music Monthly, Feb. 1996 (1 page).

Ochiva, Dan, "Hotware, A Review of New Products," Milimeter, Mar. 1996.

Oppenheimer, Steve, "1996 Winter NAMM Hitmakers", Electronic Musician May 1996, (1 page).

(List continued on next page.)

*Primary Examiner*—Jeffrey Donels
(74) *Attorney, Agent, or Firm*—Foley & Lardner

(57) ABSTRACT

A musical apparatus which controls a variety of parameters of musical tones by detecting motion of an object in a space adjacent to the musical apparatus. More specifically, the musical apparatus may comprise a musical tone signal generator which generates a musical tone signal, at least one light source which radiates light beams into a space adjacent to the musical apparatus, at least one light detector which detects at least two light beams reflected from an object in the space and generates a detection value for each of said at least two light beams, a computing element which receives the detection values and generates a synthesized value; and a controller which controls parameters of musical tones based on the synthesized value. For example, the synthesized value may be the sum of the detection values, the difference between the detection values, the ratio between the detection values, or some other relationship between the detection values.

12 Claims, 19 Drawing Sheets

OTHER PUBLICATIONS

Mulbern, Tom, "Beam Me Up! Interactive Light Dimension Beam," Guitar Shop, Jun. 1996, (1 page).

"Some Unique Applications", Interactive Light flyer, (1 page).

"1996 Hardware Buyer's Guide," Keyboard, Dec. 1995, (2 pages).

"Orchestrating Visual Sounds," Daily News, Aug. 26, 1996, (1 page).

Interactive Light Brochures, Introducing . . . "the Body Harp", (1 page).

Wilkinson, Scott, "Tech Page", "Interactive Light, MIDI control gets case in a new light," Electronic Musician, Dec. 1995, p. 162 (1 page).

Interactive Light Brochure, "Dimension Beam Model 3.0 Instructions", Feb. 27, 1996, pp. 1–18.

Interactive Light Brochure, "A new dimension in musical expression: the Dimension Beam", Jan. 9, 1984, (2 pages).

| SOURCE | UNCONDITIONALLY CONTROLLED OBJECT | | CONDITIONALLY CONTROLLED OBJECT | CONDITION |
|---|---|---|---|---|
| LED 1 OUTPUT VALUE | ASSIGNMENT 1 | PITCH BEND | BEND RANGE | LED 1 OUTPUT VALUE>10 |
| | ASSIGNMENT 2 | CUT OFF | EFFECT ON | LED 1 OUTPUT VALUE>20 |
| | ASSIGNMENT 3 | — | EFFECT OFF | LED 1 OUTPUT VALUE<30 |
| RATE OF CHANGE OF LED 1 OUTPUT VALUE | — | | SWITCHING TO THE FIRST PHRASE PERFORMANCE DATA | RATE OF CHANGE OF LED 1 OUTPUT VALUE>15 |
| LED 2 OUTPUT VALUE | ASSIGNMENT 1 | MODULATION | SWITCHING TO THE SECOND PHRASE PERFORMANCE DATA | LED 1 OUTPUT VALUE>10> LED 2 OUTPUT VALUE |
| | ASSIGNMENT 2 | RESONANCE | — | — |
| | ASSIGNMENT 3 | TEMPO | MUTE ALL PARTS | 25<LED 1 OUTPUT VALUE<30 AND 40 <LED 2 OUTPUT VALUE |
| RATE OF CHANGE OF LED 2 OUTPUT VALUE | LFO DEPTH | — | — | — |
| TOTAL VALUE OF LED 1 OUTPUT VALUE AND LED 2 OUTPUT VALUE | ASSIGNMENT 1 | VOLUME | — | — |
| | ASSIGNMENT 2 | | — | — |
| TOTAL OF ALL RATES OF CHANGE | — | | — | — |
| DIFFERENCE BETWEEN LED 1 OUTPUT VALUE AND LED 2 OUTPUT VALUE | — | | — | — |
| RATIO BETWEEN LED 1 OUTPUT VALUE AND LED 2 OUTPUT VALUE | PAN | | — | — |

*FIG. 3*

SETTING TABLE

| SOURCE | SETTING OBJECT | EFFECTIVE |
|---|---|---|
| LED 1 OUTPUT VALUE | DATA INPUT | WHEN CURSOR IS IN "CONDITION" COLUMN |
| LED 2 OUTPUT VALUE | DATA INPUT | WHEN CURSOR IS IN "CONDITION" COLUMN |
| \OTAL VALUE OF LED 1 OUTPUT VALUE AND LED 2 OUTPUT VALUE | SELECT PARAMETERS BY SMALL INCREMENTS (ONE AT A TIME) | WHEN CURSOR IS IN THE "UNCONDITIONALLY CONTROLLED OBJECT" COLUMN OR THE "CONDITIONALLY CONTROLLED OBJECT" COLUMN |
| RATIO BETWEEN LED 1 OUTPUT VALUE AND LED 2 OUTPUT VALUE | SELECT PARAMETERS BY LARGE INCREMENTS (NOT ONE AT A TIME) | WHEN CURSOR IS IN THE "UNCONDITIONALLY CONTROLLED OBJECT" COLUMN OR THE "CONDITIONALLY CONTROLLED OBJECT" COLUMN |

*FIG. 4*

| |
|---|
| LED 1 OUTPUT VALUE |
| RATE OF CHANGE OF LED 1 OUTPUT VALUE |
| LED 2 OUTPUT VALUE |
| RATE OF CHANGE OF LED 2 OUTPUT VALUE |
| TOTAL VALUE OF LED 1 OUTPUT VALUE AND LED 2 OUTPUT VALUE |
| TOTAL VALUE OF RATE OF CHANGE OF LED 1 OUTPUT VALUE AND RATE OF CHANGE OF LED 2 OUTPUT VALUE |
| DIFFERENCE BETWEEN LED 1 OUTPUT VALUE AND LED 2 OUTPUT VALUE |
| RATIO BETWEEN LED 1 OUTPUT VALUE AND LED 2 OUTPUT VALUE |

*FIG. 5*

| LED 1 VALUE | LED 2 VALUE | LED 3 VALUE | COORDINATES |
|---|---|---|---|
| 0 | 0 | 0 | (x000, y000, z000) |
| 0 | 0 | 10 | (x001, y001, z001) |
| 0 | 0 | 20 | (x002, y002, z003) |
| . | . | . | . |
| . | . | . | . |
| . | . | . | . |
| 10 | 20 | 10 | (x121, y121, z121) |
| 10 | 20 | 20 | (x122, y122, z122) |
| 10 | 20 | 30 | (x123, y123, z123) |
| . | . | . | . |
| . | . | . | . |
| . | . | . | . |
| 20 | 10 | 10 | (x211, y211, z211) |
| 20 | 10 | 20 | (x212, y212, z212) |
| 20 | 10 | 30 | (x213, y213, z213) |
| . | . | . | . |
| . | . | . | . |
| . | . | . | . |
| 90 | 90 | 90 | (x999, y999, z999) |

*FIG. 20*

CONTROL TABLE

| Source | Unconditionally Controlled Object | Conditionally Controlled Object | | Condition |
|---|---|---|---|---|
| Output value which is the greater of LED 1 output value and LED 2 output value | -- | Assignment 1 | Pitch | Absolute value of the difference < 5, and 20 > Output value > 10 |
| | | Assignment 2 | Switch to the third phrase performance data | Absolute value of the difference < 5, and 50 > Output value > 20 |
| | | Assignment 3 | Switch to the fourth phrase performance data | Absolute value of the difference < 5, and 80 > Output value > 50 |
| Total value of LED 1 output value and LED 2 output value | | Volume | | Absolute value of the difference < 5, and total value > 50 |
| Total value of LED 1 output value and LED 2 output value | -- | Cutoff | | 25 < LED 1 output value < 30, and LED 2 output value > 40 |

*FIG. 21*

MUSICAL APPARATUS USING MULTIPLE LIGHT BEAMS TO CONTROL MUSICAL TONE SIGNALS

CROSS REFERENCE TO RELATED PATENT APPLICATIONS

This application is a continuation of Ser. No. 09/421,906 filed on Oct. 20, 1999 now U.S. Pat. No. 6,153,822 which is a continuation of Ser. No. 09/209,400 filed on Dec. 10, 1998 which issued as U.S. Pat. No. 5,998,727 on Dec. 7, 1999.

The present application related to Japanese Patent Application No. Hei 9-362074, filed on Dec. 11, 1997, from which priority is based.

FIELD OF THE INVENTION

The field of the invention is electronic musical apparatuses such as electronic musical instruments, music-related sound generation devices, music-related sound modification devices, and their controllers, including, for example, synthesizers, keyboards, drum machines, effects processors, effects pedals, sequencers and sound modules. More specifically, the electronic musical apparatus embodying the invention is controlled by detecting the location and/or movement of an object (e.g., a hand) within a space by using a plurality of light beams, including infrared light beams.

BACKGROUND OF THE INVENTION

An electronic musical apparatus which detects reflected light to control the musical tone signal is known. Such a device was disclosed in Japanese Laid-Open Utility Model Application Publication Number SHO 58-195296.

Japanese Laid-Open Utility Model Application Publication Number SHO 58-195296 discloses attaching a light quantity detection apparatus in order to detect and sense the amount of ambient light outside an electronic musical apparatus. It reacts to the amount of light that has been sensed by the light quantity detection apparatus and controls parameters that are related to the musical tone (hereinafter, simply referred to as "parameters") such as the musical interval, timbre and volume.

However, in the device disclosed in Japanese Laid-Open Utility Model Application Publication Number SHO 58-195296, the amount of light is detected by a single light quantity detection apparatus, and there is no disclosure in Japanese Laid-Open Utility Model Application Publication Number SHO 58-195296 of the detection of a plurality of light quantities.

In addition, U.S. Pat. No. 5,045,687 discloses that a space is irradiated with light such as infrared light, mutually different sound pitches are assigned in advance to the multiple number of light beams reflected from the specified objects in the space, said multiple number of reflected light beams are detected and musical tone signals are produced that possess pitches which conform to the reflected light beams that have been detected.

However, in the system disclosed in U.S. Pat. No. 5,045,687, if a plurality of reflected light beams are detected, the device controls the musical tone signal based only on one of the reflected light beams, the one that is detected first. U.S. Pat. No. 5,045,687 does not disclose that controlling musical tone signals by means of the joint action of a multiple number of reflected light beams.

SUMMARY OF THE INVENTION

A first, separate aspect of the present invention is a new control mode for musical tone signals where the musical tone signal is controlled by means of the joint action of a plurality of reflected light beams.

A second, separate aspect of the present invention is a musical apparatus which has a plurality of light sources to radiate light into a space and a single light detector which detects light reflected off an object in space.

A third, separate aspect of the present invention is a musical apparatus which sets conditions and determines whether the results of the detection of light reflected off an object in space satisfy those conditions.

A fourth, separate aspect of the present invention is a musical apparatus which controls a musical tone based on whether conditions are satisfied by the results of the detection of light reflected off an object in space.

A fifth, separate aspect of the present invention is a musical apparatus which controls a musical tone based on which conditions are satisfied by the results of the detection of light reflected off an object in space.

A sixth, separate aspect of the present invention is a musical apparatus which has a single detector which detects light beams from a plurality of light sources such as infrared radiation such that the results of this detection controls a variety of parameters of musical tones.

A seventh, separate aspect of the present invention is a musical apparatus that uses a plurality of light detectors to detect light beams from a single light source such that the results of this detection controls a variety of parameters of musical tones.

An eighth, separate aspect of the present invention is a musical apparatus which locates two light emitters in an outwardly inclined manner on the casing of the musical apparatus in order to reduce the size of the casing.

A ninth, separate aspect of the present invention are steps formed in an opened port in the casing of the musical apparatus which prevent diffused reflection from being received by the light detector.

A tenth, separate aspect of the present invention is a musical apparatus which controls the order in which types of parameters of musical tones are changed.

An eleventh, separate aspect of the invention is a musical apparatus which uses the sum, difference, ratio or other relationship between the detection results of two detected light beams to control a parameter of a musical tone.

A twelfth, separate aspect of the present invention is a musical apparatus which does not require a one-to-one correspondence of light emitters to light detectors.

BRIEF DESCRIPTION OF THE DRAWINGS

The present invention will become more fully understood from the detailed description given hereinafter and the accompanying drawings which are given by way of illustration only, and thus are not limitative of the present invention, and wherein:

FIG. 3 is an explanatory diagram showing a control table;

FIG. 4 is an explanatory diagram showing a setting table;

FIG. 5 is an explanatory diagram showing a buffer;

FIG. 20 is a diagram showing an example of a conversion table.

FIG. 21 is a diagram of another example of a control table.

DETAILED DESCRIPTION OF THE PREFERRED EMBODIMENT

Figure 1:
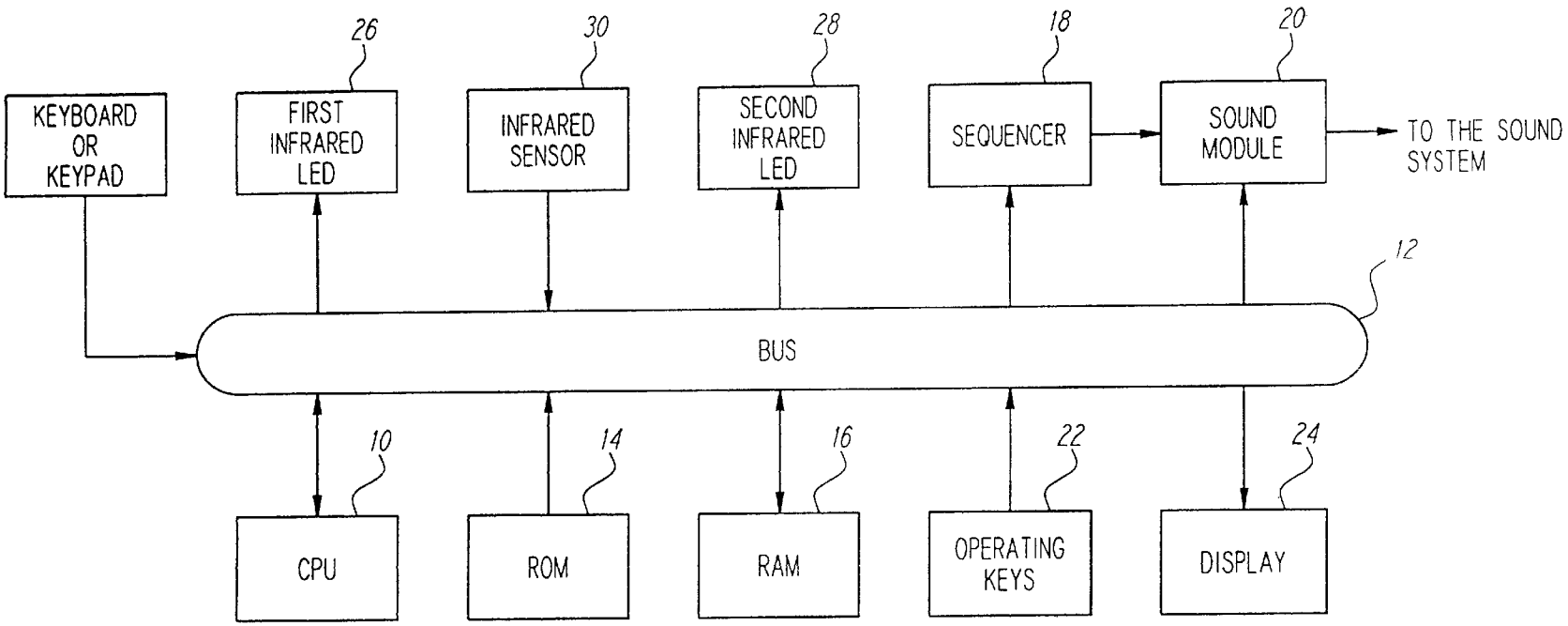
FIG. 1 is a block diagram showing an electronic musical apparatus having the musical apparatus of an embodiment of the present invention.

Embodiments of the musical apparatus according to the present invention will be described in detail hereinafter in conjunction with the accompanying drawings.

In one embodiment of the present invention, a musical apparatus which detects light rays and uses results of this detection to control musical tones may comprise a plurality of light emitters, a single light detector, and a controller for controlling parameters of musical tone. The light emitter may be a light emitting element such as an infrared light-emitting diode (infrared LED), and a plurality of light emitters may use, for example, two infrared LEDs. Likewise, a light detector may use, for example, a light receiving element such as an infrared sensor. The plurality of light emitters and the single detector are mounted on the main housing of the apparatus. The single detector detects the light rays, which were radiated from the plurality of light emitters and reflected off of a material object in space, independently for every light emitter, and outputs the results detected corresponding to each of the plurality of light emitters, respectively. In response to the detected results, the controller controls or changes parameters of a musical tone.

In this embodiment, the plurality of light emitters are, for example, positioned at a prescribed distance (see FIG. 2), or they are positioned such that the direction of radiation of the light emitted from one light emitter is different than that of another light emitter (see FIG. 16), so that when the position of a material object is changed, the light reflected off the material object also changes. The plurality of light emitters emit light in a time-sharing manner, and the single detector outputs the detection result corresponding to the light emitter which emitted light rays synchronously with the timing of the light emission. The musical apparatus may output a detection result corresponding to each one of the plurality of light emitters respectively.

An alternative embodiment of the present invention includes a plurality of light detectors where at least one detector outputs detection results with respect to a plurality of light emitters. For instance, an embodiment of the present invention may include an apparatus containing three light emitters and two detectors where one of the two detectors outputs detection results with respect to two or three emitters. Accordingly, there is no need for a 1:1 correspondence of light detectors to light emitters, which reduces costs.

In another embodiment of the present invention, the musical apparatus which detects light rays and uses the results of this detection to control musical tones may comprises one light emitter, a plurality of detectors, and a controller for controlling parameters of a musical tone. The single light emitter and the plurality of detectors are mounted on the main housing of the apparatus. The plurality of detectors detects the light rays respectively, which were radiated from the single light emitter and reflected off of a material object in space, and outputs the results detected. The controller changes parameters for a musical tone based on the detection results.

In this embodiment, a plurality of detectors are, for example, positioned at a predetermined distance, or they are positioned so as to provide differing directivity thereof in their detection regions from one another, so that when a position of the material object in space is changed, a condition in detecting the light reflected by the material object changes.

In the musical apparatus containing a plurality of light emitters, at least one light emitter is noticed in the sense that the light radiated from the light emitter is detected by a plurality of detectors. For instance, in an apparatus containing three light emitters and two detectors, one of the three light emitters may be noticed in the sense that the light rays from the light emitter is detected by two detectors. Accordingly, there is no need of a 1:1 correspondence of light emitters to light detectors, which reduces costs.

In these embodiments, the musical apparatus may further comprise a selector capable of selecting a desired parameter in a plurality of parameters, and the controller controlling changing modes of parameters selected by the selector in response to the detection results of the detectors.

In addition, the musical apparatus may still further comprise a performance mode for controlling or changing parameters of musical tones based on the detection results of a light detector, a setting mode for setting this performance mode, and a controller which, in the setting mode, sets values based on the detection results, and in the performance mode, changes parameters of musical tones based on the values set during the setting mode.

FIG. 1 is a block diagram showing an electronic musical apparatus embodying the musical apparatus of the present invention where the electronic musical apparatus is constituted such that its entire operation is controlled by the use of a central processing unit (CPU) 10, and more specifically, a bus (BUS) 12 connected the CPU 10; a read-only memory (ROM) 14 storing a program and the like executed by the CPU 10; a random access memory (ROM) 16 having an area for a control table which will be described hereinafter, an area for a buffer, similar areas for executing the program by means of the CPU 10, and a working area; a sequencer 18 in which data of musical performance for a plurality of musical pieces (the expression "data of musical performance for musical pieces" will be hereinafter referred to as "musical piece performance data") and data for musical performance expressing a phrase having a shorter performance period of time than that of musical piece performance data (the expression "data for musical performance expressing a phrase" will be hereinafter referred to as "phrase performance data", and further "phrase performance data which have been stored in a built-in ROM will be referred to as "first phrase performance data", "second performance data", and "third performance data", respectively) have been stored in a built-in ROM and which reads the musical piece performance data and phrase performance data to output the same in accordance with the processing which will be described below; a sound source 20 in which setting conditions for musical tones and the like have been stored in a built-in ROM and which produces musical tone signals on the basis of the musical piece performance data and the phrase performance data outputted from the sequencer 18 to output the signals to a sound system composed of amplifier, loudspeaker and the like; an operating key group 22 including a variety of operating keys for setting a variety of parameters which will be described below for controlling the sequencer 18; and for similar purposes, a display section 24 for displaying setting conditions for a variety of parameters which will be mentioned below and the like; a first infrared LED 26 being the first light emitting element for outputting light rays as a means for emitting light; a second infrared LED 28 being the second light emitting element for outputting light rays as a means for emitting light; and an infrared sensor 30 being a light receiving element for receiving light rays as a detecting means to detect the same, respectively.

Figure 2:
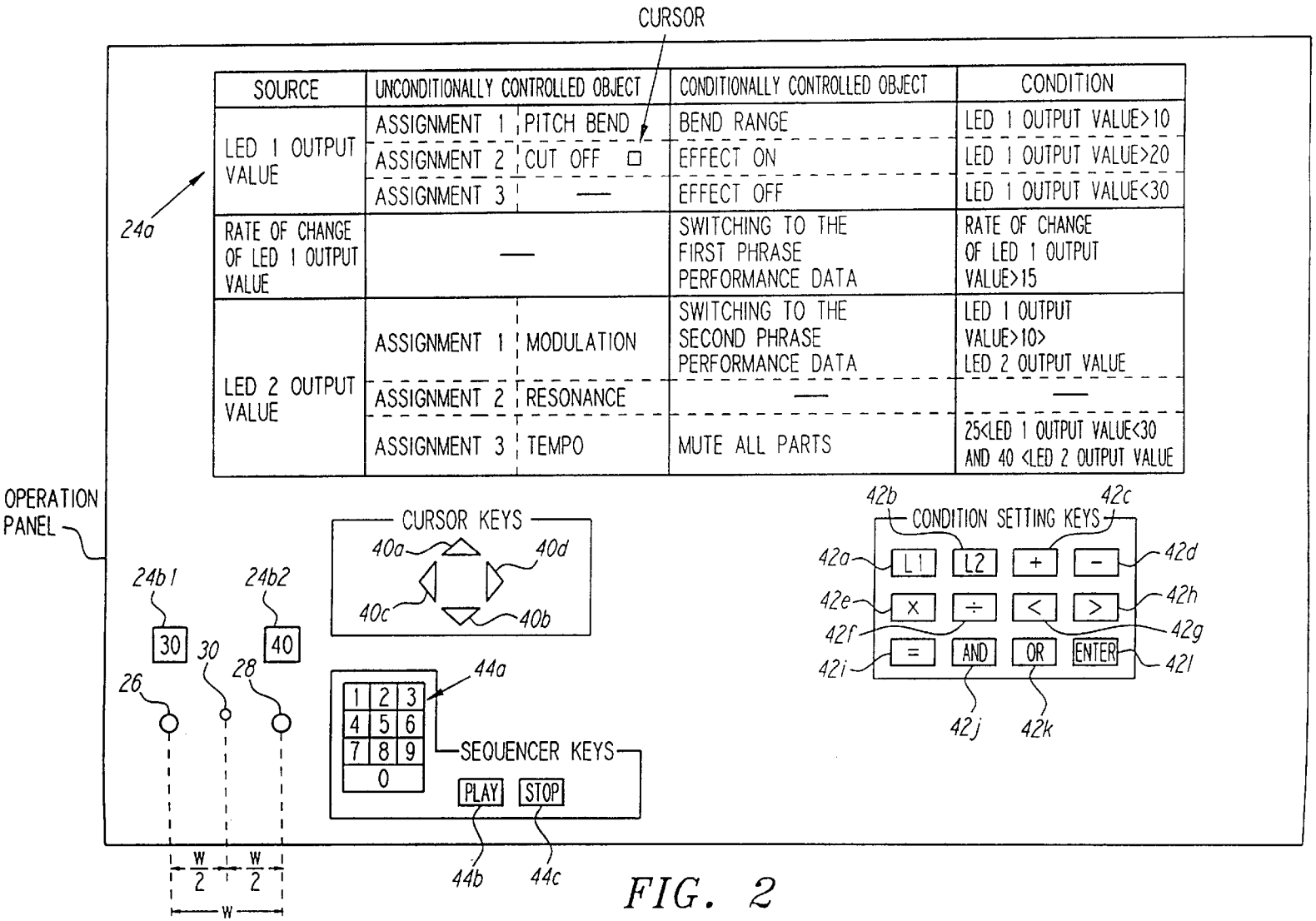
FIG. 2 is an explanatory diagram showing an operation panel of the electronic musical apparatus.

FIG. 2 illustrates an operation panel provided with a variety of operating keys comprising the operating key group 22, a display screen for control table 24*a* which is formed with an LCD display section 24, sensor level indicators 24*b*1 and 24*b*2, a first infrared LED 26, a second infrared LED 28, and an infrared sensor 30.

In FIG. 2, the display screen for control table 24*a* displays a setting condition of parameters for the control table which has been stored in the RAM 16 and will be described hereinafter. The display screen for control table 24*a* displays a portion of the control table, and the remaining portion may be displayed by scrolling the screen by the use of operating keys for shifting a cursor which will be described hereafter.

In FIG. 2, the first infrared LED 26 and the second infrared LED 28 are placed on the upper part of the operation panel with a predetermined spacing W, and the infrared sensor 30 is disposed halfway between the LEDs.

Accordingly, when the first infrared LED 26 and the second infrared LED 28 are allowed to emit light in a time-sharing manner by holding a part of human body such as a hand or other material objects over the infrared sensor 30, the light rays emitted by the LEDs are reflected off of the human body or material object, and the resulting reflected light is directed to the infrared sensor 30. As a result, the infrared sensor 30 detects the reflected light corresponding to the first infrared LED 26 and the second infrared LED 28 in accordance with a time-sharing manner. Based on two kinds of output values of the infrared sensor 30 which are the detected results of the reflected light thus detected of the first infrared LED 26 and the second infrared LED 28, respectively, it is possible to control complicated parameters.

More specifically, when a human body, material object, or the like is suitably moved over the infrared sensor 30, the reflected light derived from emission of the first infrared LED 26 and the second infrared LED 28 varies, so that two kinds of output values of the infrared sensor 30 also vary in accordance with the changes in the reflected light. Thus, parameters can be controlled arbitrarily in response to changes in these output values, whereby control for complicated parameters can easily be made.

For instance, in the case where two infrared LEDs and one infrared sensor are used, the two infrared LEDs are used in a time-sharing manner, the light rays emitted are suitably reflected by human body, material object, or the like, and the reflected light corresponding to the respective LED is detected by a single infrared sensor in a time-sharing manner. In other words, reflected light derived from a plurality of (e.g., two) infrared LEDs is detected by one infrared sensor in a time-sharing manner, and a variety of parameters are controlled on the basis of two kinds of output values which are the detection results of the respective reflected light of two infrared LEDs thus detected by the single infrared sensor.

When the human body, material object, or the like is suitably moved, the reflected light derived from the respective infrared LEDs changes which cause the two kinds of output values in an infrared sensor to change, so that parameters can be arbitrarily controlled in response to changes in these output values.

There are two ways to control parameters on the basis of the above described two kinds of output values by one infrared sensor. For example, one way is to control parameters unconditionally in real time based on the above described two kinds of output values (real time control), and the other way is to control parameters in real time where the above described two kinds of output values satisfy a predetermined condition (conditional real time control).

First, real time control will be described in detail. This real time control is a manner wherein separate parameters are assigned to the above described two kinds of output values, respectively, and the corresponding parameters are controlled in response to the respective output values. For instance, pitch-bend is assigned as a parameter to an output value obtained as a result of detecting the reflected light originating from a first infrared LED (hereinafter referred to as "LED1" in this paragraph) out of two infrared LEDs by one infrared sensor (hereinafter referred to as "LED1 output value" in this paragraph), while modulation is assigned as another parameter to an output value obtained as a result of detecting the reflected light originating from a second infrared LED (hereinafter referred to as "LED2" in this paragraph) out of two infrared LEDs by one infrared sensor (hereinafter referred to as "LED2 output value" in this paragraph), whereby the output values may be used to control operation of the musical apparatus.

In real time control mode, parameters may be controlled, for example, in accordance with the following manner:

(1) A plurality of parameters respectively may be assigned to the LED1 output value and LED2 output value. For example, by assigning pitch-bend and cut-off of filter as parameters to LED1 output value, these parameters may be controlled.

(2) Parameters are assigned to the operation results which are obtained by performing certain arithmetic computations to LED1 output value and LED2 output value, and the corresponding parameters are controlled based on the operation results. For instance, arithmetic computations are performed on LED1 output value to determine the rate of change in LED 1 output value, and resonance of filter is assigned as a parameter to the rate of change in LED1 output value being the operation result, whereby the resonance of filter may be controlled in response to the rate of change in LED1 output value.

(3) Parameters may be assigned to a synthesized value of LED1 output value and LED2 output value (synthetic value), and the corresponding parameters may be controlled in response to the synthetic value. For example, volume has been assigned as a parameter to a value obtained by adding LED1 output value to LED2 output value (sum or total value) as a synthetic value, and the volume may be controlled in response to changes in the total value. The synthetic value is not limited to the summed value of LED1 output value and LED2 output value (total value), but can also be a value obtained by determining a difference between LED1 output value and LED2 output value (difference value), a ratio of LED1 output value to LED2 output value and other derived values.

(4) Parameters may be assigned to a rate of change in synthetic value, and the corresponding parameters may be controlled in response to the rate of change in synthetic value.

Next, conditional real time control will be described in detail. The conditional real time control mode is a manner by which parameters are controlled when a certain condition is satisfied by the LED1 output value, the LED2 output value and the like, so that the conditional real time control is suitably used to implement an ON/OFF switch-like control. For instance, when LED1 output value becomes a predetermined value or more, bend range is allowed to vary, or when LED2 output value becomes a predetermined value or more, effect is turned ON and when LED2 output value becomes less than a predetermined value, effect is turned OFF.

In the conditional real time control mode, parameters may be controlled in accordance with the manner of, for example, the following Items (1) to (4).

(1) A plurality of conditions may be set to one of the output values (e.g., LED1 output value, LED2 output value, or the like), and parameters may be controlled when the conditions are satisfied.

(2) Parameters are assigned to the operation results which are obtained by performing certain arithmetic computations to the LED1 output value and the LED2 output value, and the corresponding parameters are controlled when a predetermined condition is satisfied by the operation results.

(3) Parameters are assigned to a synthesized value of LED1 output value and LED2 output value (synthetic value), and the corresponding parameters may be controlled, when a predetermined condition is satisfied by the synthetic value. For example, predetermined phrases have been assigned in response to values obtained by adding LED1 output value to LED2 output value (sum or total value) as synthetic values, and it may be controlled so as to switch the phrases in response to changes in the total value. The synthetic value is not limited to the summed value of LED1 output value and LED2 output value (total value), but may be a value obtained by determining a difference between LED1 output and LED2 output value (difference value), a ratio of LED1 output value to LED2 output value, and other values.

(4) Parameters are assigned to a rate of change in synthetic value, and the corresponding parameters may be controlled when a predetermined condition is satisfied by the rate of change in synthetic value.

As shown in FIG. 2, a level value "30" of the reflected light due to emission of the first infrared LED 26 detected by the infrared sensor 30 is displayed on the sensor level indicator 24*b*1, while a level value "40" of the reflected light due to lighting of the second infrared LED 28 detected by the infrared sensor 30 is displayed on the sensor level indicator 24*b*2.

Operating keys composing the operating key group 22 include operating keys for shifting cursor displayed on the display screen 24*a* for the control table (an upward operating key 40*a* for upward shift of the cursor, a downward operating key 40*b* for downward shift of the cursor, a leftward operating key 40*c* for leftward shift of the cursor, and a rightward operating key 40*d* for rightward shift of the cursor), condition setting operating keys for setting a variety of conditions with respect to control for parameters (an L1 operating key 42*a* for designating an output value obtained as a result of detecting reflected light of the first infrared LED 26 by the infrared sensor 30 (in this paragraph, hereinafter referred to as "LED 1 output value"), an L2 operating key 42*b* for designating an output value obtained as a result of detecting reflected light of the second infrared LED 28 by the infrared sensor 30 (hereinafter referred to as "LED 2 output value" in this paragraph), a + operating key 42*c* for designating sign "+" in mathematics used in a condition formula, a − operating key 42*d* for designating sign "−" in mathematics used in a condition formula, a × operating key 42*e* for designating multiplicative sign "×" in mathematics used in a condition formula, a ÷ operating key 42*f* for designating sign "÷" in mathematics used in a condition formula, a < operating key 42*g* for designating sign "<" in mathematics used in a condition formula, a > operating key 42*h* for designating sign ">" in mathematics used in a condition formula, an = operating key 42*i* for designating sign "=" in mathematics used in a condition formula, an and operating key 42*j* for specifying "AND" condition, an or operating key 42*k* for specifying "OR" condition, a fixation operating key 421 for fixing a condition formula, and sequencer operating keys for controlling a sequencer (ten-button operating keys 44*a* for specifying a musical piece to be performed, a play operating key 44*b* for instructing the start of performance, and a stop operating key 44*c* for instructing the stop of performance).

As described above, the display screen 24*a* for the control table is adapted to display the control table which has been stored in the RAM 16 and will be described hereunder. In the case where no automatic performance is conducted by the sequencer 18, the types of parameters and parameter values of a variety of parameters are specified arbitrarily by means of the above described operating keys for shifting cursor and LED1 output value as well as LED2 output value, whereby the control table can be set. An example of the control table which has been thus set is shown in FIG. 3 wherein objects to be assigned to parameters are shown in the "SOURCE" column. The objects to be set in the column "SOURCE" are "LED1 OUTPUT VALUE", "RATE OF CHANGE OF LED1 OUTPUT VALUE", "LED2 OUTPUT VALUE", "RATE OF CHANGE OF LED2 OUTPUT VALUE", "TOTAL VALUE OF LED1 OUTPUT VALUE AND LED2 OUTPUT VALUE" and "TOTAL VALUE OF RATE OF CHANGE OF LED1 OUTPUT VALUE AND RATE OF CHANGE OF LED2 OUTPUT VALUE" (expressed as "TOTAL OF ALL RATES OF CHANGE" in FIG. 3), "DIFFERENCE BETWEEN LED1 OUTPUT VALUE AND LED2 OUTPUT VALUE", and "RATIO BETWEEN LED1 OUTPUT VALUE AND LED2 OUTPUT VALUE."

Furthermore, the column "UNCONDITIONALLY CONTROLLED OBJECT" and the column "CONDITIONALLY CONTROLLED OBJECT" in the control table shown in FIG. 3 display the parameter names of the parameters assigned to corresponding column "SOURCE" respectively.

The column "CONDITION" in the control table shown in FIG. 3 displays the conditions which are set to their corresponding respective parameters shown in the "CONDITIONALLY CONTROLLED OBJECT" column.

It is to be noted that three parameters "ASSIGNMENT 1", "ASSIGNMENT 2" and "ASSIGNMENT 3" can be assigned to both the LED1 output value and LED2 output value in the column "SOURCE" respectively, while two parameters "ASSIGNMENT 1" and "ASSIGNMENT 2" can be assigned to the total value of the LED1 output value and the LED2 output value.

Described in detail below is an operating manner for arbitrarily specifying types of parameters and parameter values of a variety of parameters by means of the operating keys for shifting cursor as well as the LED1 output value and the LED2 output value.

First, the cursor displayed on the display screen 24*a* for control table is shifted to a position in either the column "UNCONDITIONALLY CONTROLLED OBJECT" or the column "CONDITIONALLY CONTROLLED OBJECT" corresponding to a desired source by the use of the operating keys for shifting cursor, the reflected light from the first infrared LED 26 and that from the second infrared LED 28 are allowed to vary by holding a hand over the sensor 30, whereby the LED1 output value and the LED2 output value are permitted to vary to select the types of desired parameters. In this case, when the hand is held over the infrared sensor 30, the types of parameters corresponding to upper and lower positions of the hand (the total value of the LED1 output value and the LED2 output value) are obtained.

Furthermore, when the hand is moved upwards and downwards, the position of the hand alters the types of parameters by small increments (one by one) in correspondence to the upper and lower positions of the hand (the total value of the LED1 output value and the LED2 output value). Namely, if the types of parameters have been set in the order of, for example, "resonance→modulation→tempo→pitch bend→cut-off . . . " in response to the upper and lower positions of the hand, the type of parameter is switched one at a time cyclically through the order of "resonance→modulation→tempo→pitch bend→cut-off . . . " when the hand is moved upward and downward.

When a hand is moved rightward and leftward, the types of parameters are adapted to be altered by larger increments (e.g., not one at a time) based on the right and left positions of the hand (a ratio of the LED1 output value to the LED2 output value). More specifically, alteration is applied to the types of parameters determined by the above described upper and lower positions of hand, so that if "resonance" is selected by the upper and lower positions of the hand, the type of parameter is switched at a greater increment cyclically through the order to, for example, "pitch bend".

Furthermore, when the cursor on the display screen 24*a* for control table is shifted to a position in the column "CONDITION" corresponding to a desired source by the use of the operating keys for shifting the cursor, a function different from that of selection of parameters is executed by changing the LED1 output value and the LED2 output value of the infrared sensor 30.

First, it is selected that either the LED1 output value is used, or the LED2 output value is used as an object for condition by touching the L1 operating key 42*a* or the L2 operating key 42*b* among the operating keys for setting condition. Then, conditions to be set in respect of a formula and a relationship of magnitude are established by touching the + operating key 42*c*, the − operating key 42*d*, the × operating key, the ÷ operating key 42*f*, the < operating key 42*g*, the > operating key 42*h*, and the = operating key 42*i*. Furthermore, a hand is held over the infrared sensor 30 to change the reflected light from the first infrared LED 26 and the second infrared LED 28, whereby the LED1 output value and the LED2 output value are changed to set values in the "CONDITION" column which are compared with the LED1 output value or the LED2 output value. Thereafter, when the fixation operating key 421 is touched, the above described LED1 output value and the LED2 output value which have been set are inputted as a condition in the numerical values without any modification.

In the case when a condition is established as described above, an AND condition or OR condition can also be set with respect to source as in the condition in the "ASSIGNMENT 3" column for the LED2 output value. In such a case where these conditions are specified, a certain condition has been set as described above, then the operating key 42*j* or the or operating key 42*k* on the panel is touched, and further next condition is inputted.

It is common in all the setting procedure in the control table that the setting of conditions at the previous position of the cursor is fixed in the case when the cursor is further shifted.

As a result, the setting of conditions for the control table established as described above becomes effective during automatic performance, so that when corresponding parameters are controlled in response to the LED1 output value and the LED2 output value, musical tones can be controlled in real time as a result of controlling the sequencer 18 and the sound source 20 in response to the above control for parameters. In other words, the control table is used in the case of controlling musical tones in real time during automatic performance as described above.

Moreover, the setting table shown in FIG. 4 has been stored in the RAM 16 in addition to the above described control table.

The setting table defines the LED1 output value and the LED2 output value as well as the values operated by employing the LED1 output value and the LED2 output value reflected to what kind of matter under the condition where no automatic performance is conducted.

According to the setting of this setting table, when the fixation operating key 421 is touched in the case where the cursor is at a position in the "CONDITION" column on the display screen 24*a* for the control table, the LED1 output value or the LED2 value can be utilized directly as data.

FIG. 5 shows a buffer which has been established in the RAM 16 and is required for speed arithmetic computations and other operations. The buffer is adapted to store in the RAM 16 the LED1 output value, the rate of change in LED1 output value, the LED2 output value, the rate of change in LED2 output value, the total value of LED1 output value and LED2 output value, the sum or total value of the rate of change in LED1 output value and the rate of change in LED2 output value, a difference value between LED1 output value and LED2 output value, and a ratio between LED1 output value and LED2 output value in case of the preceding arithmetic computations.

The electronic musical apparatus is provided with a temporary memory for storing the new LED1 output value and new LED2 output value which correspond to the preceding LED1 output value and preceding LED2 output value in FIG. 5 in the RAM 16, so that detection of whether the respective values are changed/not changed is effected by comparing the buffer with the temporary memory.

In accordance with the constitution as described above, processing contents executed by the electronic musical apparatus will be described by referring to the accompanying flowcharts.

When the power is turned on, the electronic musical apparatus repeatedly executes a main routine (not shown) at high speed, so that detection processing for the operating state of a variety of operating keys in the operating key group 22 is carried out, and processing based on the detected results is effected in accordance with the above described detection processing in the main routine. More specifically, in the main routine, when the play operating key 44*b* is turned ON after specifying a desired musical piece by means of the ten-key operating key 44*a*, such processing for automatic performance that musical piece performance data corresponding to the aforesaid musical piece specified is read from the sequencer 18 to output the data to the sound source 20, whereby musical tone signals are produced by means of the sound source 20 based on the musical piece performance data to output the musical tone signals thus produced is conducted, or processing for stopping the automatic performance is carried out when the stop operating key 44*c* is turned ON during automatic performance.

Since these processes can be implemented readily by those of skill in the art, a more detailed explanation of the actual implementation of the processes will be omitted.

Figure 6:
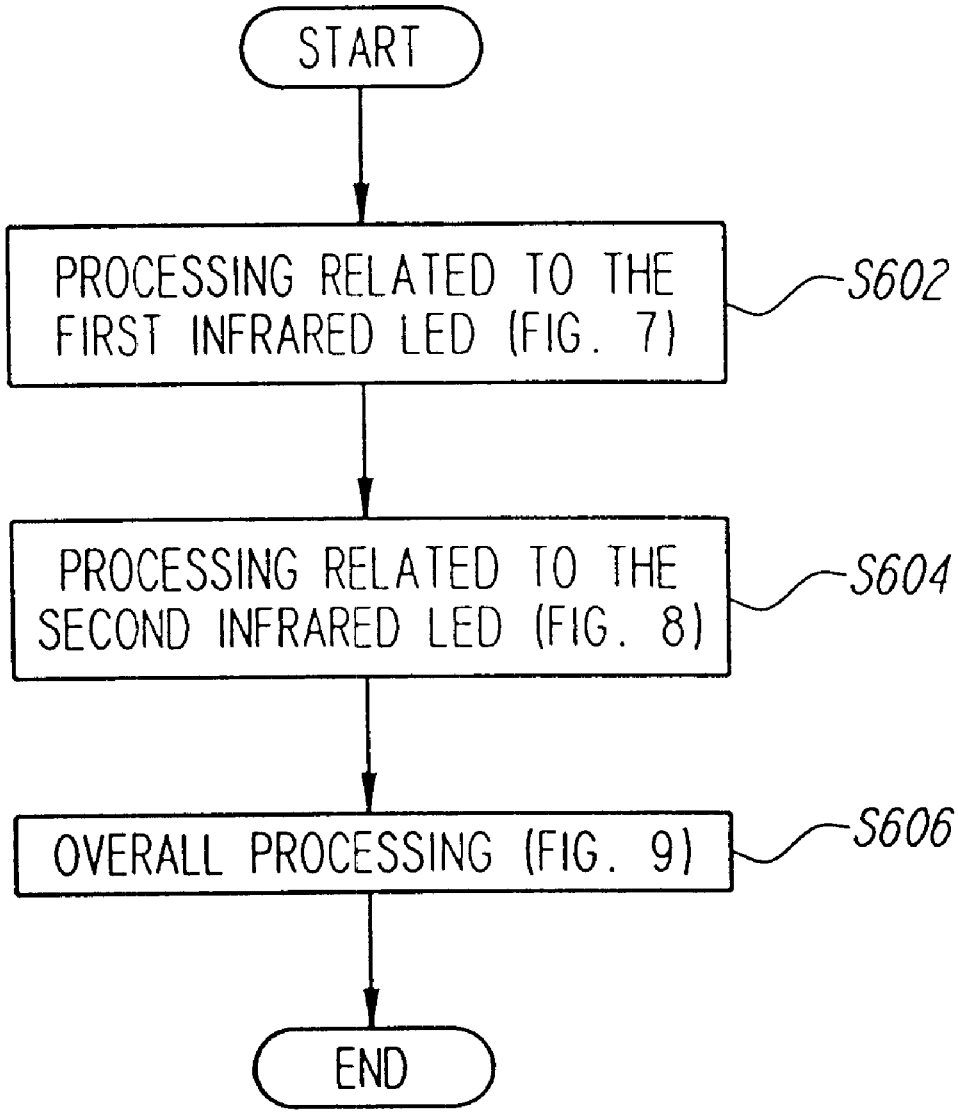
FIG. 6 is a flowchart showing a timer interrupt routine.

FIG. 6 is a flowchart showing a timer interrupt routine which is repeatedly executed at every predetermined period of time, for example, every 5 msec. or the like.

When this timer interrupt routine is started, a subroutine for processing the first infrared LED 26 (FIG. 7) is executed in step S602.

Then, when the processing in step S602 is finished, the procedure proceeds to step S604 wherein a subroutine for processing the second infrared LED 28 (FIG. 8) is executed.

Thereafter, when the processing in step 604 is finished, the procedure proceeds to step S606 wherein a subroutine for overall processing (FIG. 9) is executed to complete processing for the timer interrupt routine.

Figure 7:
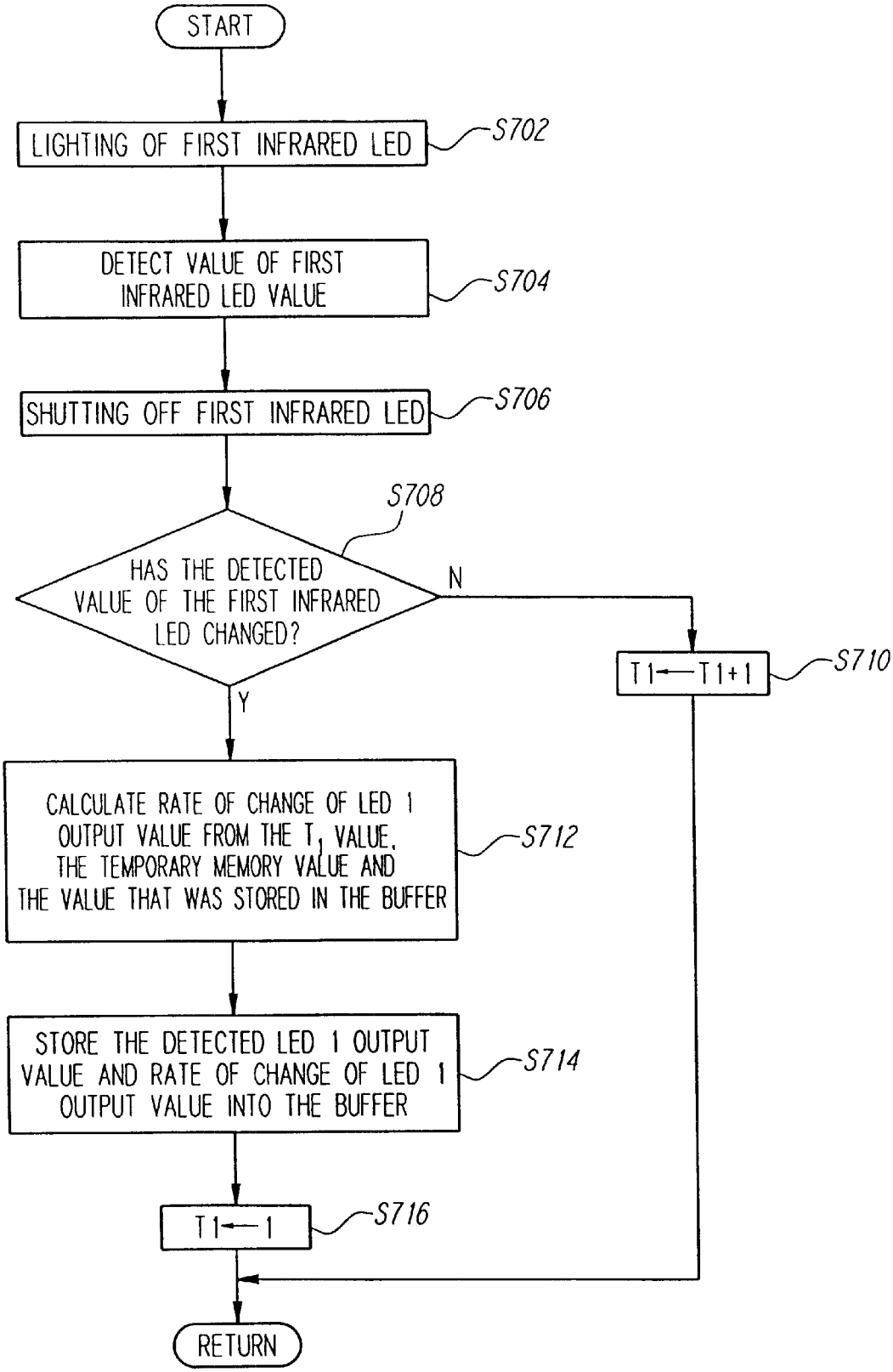
FIG. 7 is a flowchart showing a subroutine for processing of a first infrared LED.

A subroutine for processing the first infrared LED 26 shown in FIG. 7 is explained as follows. First, in step S702, the first infrared LED 26 is lit (i.e., emits light).

When step S702 is finished, the procedure proceeds to step S704 wherein an LED 1 output value with respect to the reflected light of the first infrared LED 26 is detected by the infrared sensor 30, and the LED1 output value thus detected has been stored in a temporary memory.

When step S704 is finished, the procedure proceeds to step S706 wherein the first infrared LED 26 is shut off (i.e., not emitting light).

A series of steps for the first infrared LED 26 (light emission (step S702)→detection (step S704)→shutting off (step S706)) as well as a series of steps for the second infrared LED 28 which will be described hereinafter (light emission (step S802)→detection (step S804)→shutting off (step S806)) are adapted to be carried out in a time-sharing manner.

When step S706 is finished, the procedure proceeds to step S708 wherein the buffer is compared with the temporary memory, whereby it is judged whether or not the LED1 output value which has been stored in the temporary memory in the step S704 is identical to the LED1 output value which had been previously stored in the buffer.

In the case when it is judged that the LED1 output value which was stored in the temporary memory is identical to the LED1 output value which was stored in the buffer in the past in step S708, the procedure proceeds to step S710 to increment an elapsed time T1 (which is adapted to be stored in the RAM 16) (not shown)) by "1", then the subroutine for processing the first infrared LED 26 is completed, and the procedure returns to the timer interrupt routine shown in FIG. 6.

On the other hand, in the case when it is judged that the LED1 output value which has been stored in the temporary memory is not identical to the LED1 output value which had been stored in the buffer in the past (namely, it was judged that there was a change in the LED1 output value in step S708), the procedure proceeds to step S712 wherein the duration during which the LED1 output value which was stored in the buffer has not been renewed is determined by referring to elapsed time T1, and a rate of change in the LED1 output value is calculated from the following equation (1).

$$\text{Rate of change} = (\text{Value of Temporary Memory} - \text{Value of Buffer})/T1 \qquad \text{Equation (1)}$$

When the processing for step S712 is finished, the procedure proceeds to step S714 wherein the LED1 output value detected in step S702 and the rate of change in the LED1 output value determined by the arithmetic computations in step S712 are stored in the corresponding locations in the buffer.

When the processing for step S714 is finished, the procedure proceeds to step S716 wherein the elapsed time T1 is cleared, the subroutine for processing the first infrared LED 26 is completed, and the procedure returns to the time interrupt routine shown in FIG. 6.

Figure 8:
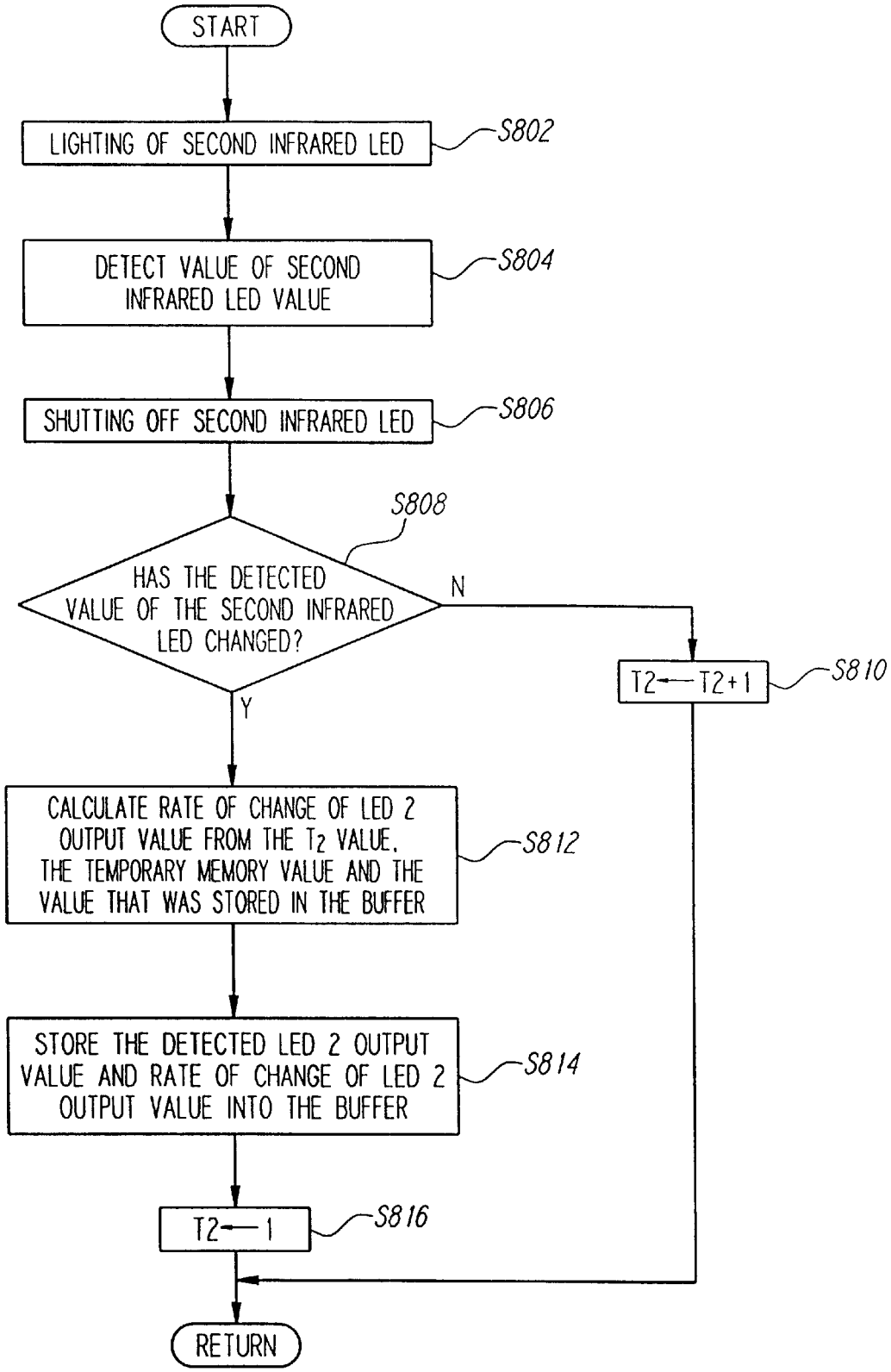
FIG. 8 is a flowchart showing a subroutine for processing of a second infrared LED.

By the following, a subroutine for processing the second infrared LED 28 shown in FIG. 8 will be described. First, the second infrared LED 28 is lit in step S802. As described above, lighting control is performed in a time-sharing manner with respect to emission (turn on) of the first infrared LED 26 as well as emission of the second infrared LED 28.

When the processing of step S802 is finished, the procedure proceeds to step S804 wherein an LED2 output value with respect to the reflected light of the second infrared LED 28 is detected by the infrared sensor 30, and the LED2 output value thus detected is stored in the temporary memory.

When step S804 is finished, the procedure proceeds to step S806 wherein the second infrared LED 28 is shut off.

When step S806 is finished, the procedure proceeds to step S808 wherein the buffer is compared with the temporary memory, whereby it is judged whether or not the LED2 output value which has been stored in the temporary memory in the step S804 is identical to the LED2 output value which had been stored in the buffer in the past.

In the case when it is judged that the LED2 output value which has been stored in the temporary memory is identical to the LED2 output value which had been stored in the buffer in the past in step S808, the procedure proceeds to step S810 to increment an elapsed time T2 (which is adapted to be stored in the RAM) (not shown)) by "1", then the subroutine for processing the second infrared LED 28 is completed, and the procedure returns to the timer interrupt routine shown in FIG. 6.

On the other hand, in the case when it is judged that the LED2 output value which has been stored in the temporary memory is not identical to the LED2 output value which had been stored in the buffer in the past (in other words, it was judged that there was a change in the LED2 output value in step S808), the procedure proceeds to step S812 where the duration during which the LED2 output value which was stored in the buffer has not been renewed is determined by referring to the elapsed time T2, and a rate of change in the LED2 output value is calculated from the above described equation (1) where "T1" is replaced by "T2".

When the processing for step S812 is finished, the procedure proceeds to step S814 where the LED2 output value detected in step S802 and the rate of change in the LED2 output value determined by the arithmetic computations in step S812 are stored in the corresponding locations in the buffer.

When the processing for step S814 is finished, the procedure proceeds to step S816 wherein the elapsed time T2 is cleared, the subroutine for processing the second infrared LED 28 is completed, and the procedure returns to the time interrupt routine shown in FIG. 6.

Figure 9:
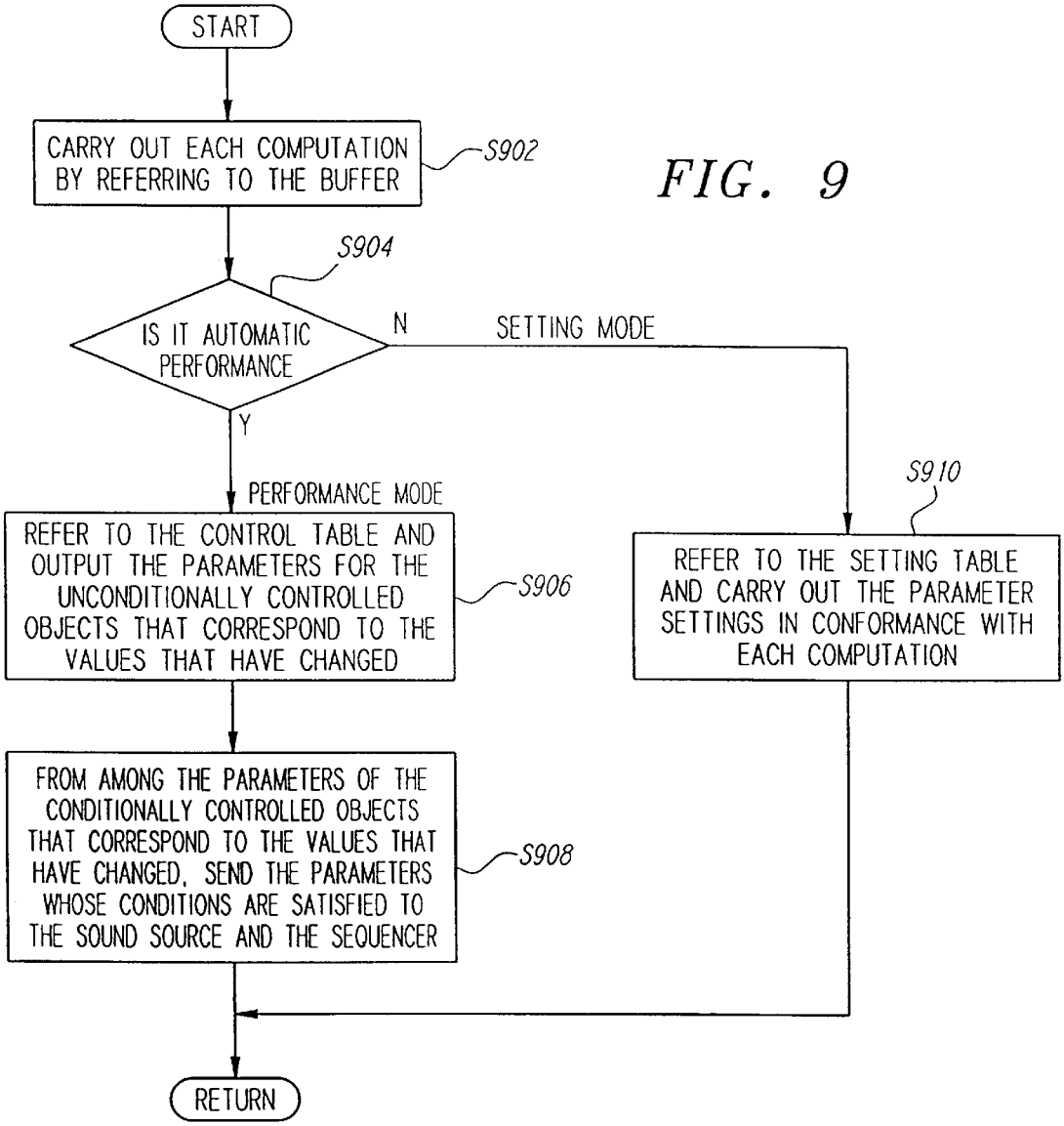
FIG. 9 is a flowchart showing a subroutine for overall processing.

By the following, a subroutine for the overall processing shown in FIG. 9 will be described. First, the LED1 output value, the LED2 output value, the rate of change in LED1 output value, and the rate of change in LED2 output value have been stored in the buffer, a total value of the LED1 output value and the LED2 output value, a total value of the rate of change in LED1 output value and the rate of change in LED2 output value, a difference value between the LED1 output value and the LED2 output value, and a ratio of the LED1 output value to the LED2 output value may be computed arithmetically by referring to the stored contents in the buffer in a step S902, and the results of the arithmetic computations are stored in the buffer.

These predetermined arithmetic computations may be performed by a computing logic. An example of the arithmetic computations performed by the computing logic includes:

(1) An operation for obtaining a sum of values in a plurality of (at least two) detection results;

(2) An operation for obtaining a ratio of values in a plurality of (at least two) detection results;

(3) An operation for obtaining a difference of values in a plurality of (at least two) detection results;

(4) An operation for obtaining a rate of change in values in respective detection results;

(5) An operation for obtaining a sum of rate of change in values of respective detection results; and the like.

When step S902 is finished, the procedure proceeds to step S904 wherein it is determined whether or not automatic performance is playing.

In the case when it is judged that automatic performance is playing in step S904 (in other words, in the case of performance mode), the procedure proceeds to step S906 wherein a "UNCONDITIONALLY CONTROLLED OBJECT" column in the control table is referred to, and a parameter value of the parameter which varies among the parameters in the "UNCONDITIONALLY CONTROLLED OBJECT" column is outputted to the sequencer 18 and the sound source 20 based on the type of the parameter.

In other words, with regard to the parameter that is assigned to the source which has had the value that was stored in the buffer rewritten, a parameter value is output that corresponds to the value of the source that has been stored in the buffer.

At this time, with regard to the parameters that are changed continuously such as the "bend range" that is exemplified by FIG. 3, the parameter value that corresponds to the value that is stored in the buffer of the source to which that parameter is assigned is output. In addition, at this time, with regard to parameters other than the "bend range" that is exemplified by FIG. 3 that are switched between switchable states such as "effect on" and "effect off," the parameter value that indicates the state such as "effect on" and "effect off" that corresponds to the state following the switching is output.

When the processing in step S906 is finished, the procedure proceeds to step S908 wherein a "CONDITION" column in the control table is referred to, and such parameter in which the LED1 output value, the LED2 output value, and the operated values are in accord with a certain condition is searched, whereby a value of the parameter which is in accord with the condition of the type of parameter in the "CONDITIONALLY CONTROLLED OBJECT" column in the control table is outputted to the sequencer 18 and the sound source 20 in response to the type of parameter, the subroutine for the overall processing is completed, and the procedure returns to the timer interrupt routine shown in FIG. 6.

On the other hand, in the case when it is judged that automatic performance is not playing in step S904 (in other words, in the case of setting mode), the procedure proceeds to step S910 wherein the setting table is referred to, the types of parameters are successively switched one by one in accordance with an order which has been previously set in response to changes in the total value of an LED1 output value and an LED2 output value in the case where the cursor is either in "UNCONDITIONALLY CONTROLLED OBJECT column or in "CONDITIONALLY CONTROLLED OBJECT" column, and the types of parameters are switched by larger increments (i.e., not one at a time) through the order which has been previously set in response to changes in a ratio of the LED1 output value to the LED2 output value.

In this case, when a hand is held over the infrared sensor 30 and the hand is moved upward and downward, the total value of LED1 output value and LED2 output value varies, so that the types of parameters can be switched successively one by one in accordance with an order which has been previously set, whereas when the hand is held over the infrared sensor 30 and the hand is moved rightward and leftward, the ratio of LED1 output value to LED2 output value changes, so that the types of parameters can be switched by larger increments (i.e., not one at a time) through an order which has been previously set.

The order for switching parameters has been previously determined as described above, and the order is stored in the ROM 14, so that the switching order is decided by absolute position.

Furthermore, in the case when the setting table is referred to and the cursor is in the "CONDITION" column in step S910, the LED1 output value or LED2 output value is inputted as a parameter for the condition without any modification. More specifically, when an operator intends to set a condition, a position corresponding to the condition to be set can be sensibly set in accordance with such a simple manner that his (or her) hand is held over the infrared sensor 30, a desired position is specified by the hand, and then the fixation operating key 42 is touched.

Dependent upon a manner for setting the "CONDITION" column and the "CONDITIONALLY CONTROLLED OBJECT" column in the control table, a unique control becomes possible.

For instance, if "LED1 output value<n (n is an natural number)" is set in the "CONDITION" column of "ASSIGN- MENT 1" wherein the LED1 output value is in the "SOURCE" column, if pitch-bend has been set in the "CONDITIONALLY CONTROLLED OBJECT" column of the "ASSIGNMENT 1" corresponding to the "CONDITION" column of the "ASSIGNMENT 1, further if "LED1 output value>n (n is an natural number) is set in the "CONDITION" column of "ASSIGNMENT 2" wherein the LED1 output value is in the "SOURCE" column, and if modulation has been set in the "CONDITIONALLY CONTROLLED OBJECT" column of the "ASSIGNMENT 2" corresponding to the "CONDITION" column of the "ASSIGNMENT 2, then pitch-bend functions in the case when the LED1 output value detected is less than n, while modulation functions in the case when the LED1 output value is more than n.

When the processing for the above described step S910 is completed, the procedure returns to the timer interrupt routine shown in FIG. 6.

It is preferred that parameters which vary in a continuous manner are generally assigned into the "UNCONDITIONALLY CONTROLLED OBJECT" column for the control table. For instance, it is preferred that parameters such as pan, volume, pitch-bend, cut-off resonance, modulation, low frequency oscillator ("LFO") depth, LFO rate, and expression are assigned into the "UNCONDITIONALLY CONTROLLED OBJECT" column.

Furthermore, when note number is set in the "UNCONDITIONALLY CONTROLLED OBJECT" column for the control table as a parameter, it becomes possible to carry out musical tone control simulating glissando performance.

Although a parameter changing continuously may be assigned into "CONDITIONALLY CONTROLLED OBJECT" column for the control table, a switch-like parameter which takes only two states (for example, ON/OFF states) may also be assigned. For instance, it is preferred that a parameter instructing the cessation of the performance of the sequencer, a parameter instructing the switching of tracks of the sequencer, a parameter for instructing mute (shut-off) for a particular track in the sequencer, a parameter instructing mute for all the tracks in the sequencer, a parameter instructing ON/OFF for effect, a parameter instructing a switch for effect type, parameter instructing trigger for a predetermined phrase and similar parameters are assigned into "CONDITIONALLY CONTROLLED OBJECT" column for the control table.

While a variety of parameters to be assigned to the "UNCONDITIONALLY CONTROLLED OBJECT" column and the "CONDITIONALLY CONTROLLED OBJECT" column for the control table have been described above, they are provided as mere exemplification, so that any of parameters relating to sound source and sequencer may arbitrarily be assigned to the "UNCONDITIONALLY CONTROLLED OBJECT" column and/or the "CONDITIONALLY CONTROLLED OBJECT" column for the control table. As a result, a variety of controls for musical tone can be realized depending on the setting manner.

Although the illustration by means of a flowchart is omitted, the LED1 output value and LED2 output value may be indicated by numerical values in the sensor level indicators **24*b*1 and 24*b*2, respectively, such that when the LED1 output value approaches the LED2 output value, the display of the sensor level indicators 24*b*1 and 24*b*2** blinks.

Alternatively, it may also be arranged such that the display of the sensor level indicators **24*b*1 and 24*b*2 blinks in the case when the LED1 output value and the LED2 output value approach a condition established in the "CONDITION" column for the control table. In this case, it may be adapted such that when LED1 output value approaches conditions for the LED1 output value (sensor 1 output value, rate of change in sensor 1 output value, and the like), the display of the sensor level indicator 24*b*1 is allowed to blink, and when LED2 output value approaches conditions for the LED2 output value (sensor 2 output value, rate of change in sensor 2 output value and the like), the display of the sensor level indicator 24*b*2** is permitted to blink.

Moreover, the ways in which an indicator is displayed is not limited to those described above, but may include the following additional nonexhaustive examples. As the LED1 output value gets closer to the LED2 output value, the flashing cycle can become shorter (or longer), the pattern for blinking can be varied, or only the sensor level indicator representative of the LED which is larger (or smaller) in value as a result of comparing the LED1 output value with the LED2 output value is flashed.

The arithmetic computations as to the LED1 output value and the LED2 output value which have been described above is not restricted to operations involving four rules, but includes other operations such as differential, binomial differential, and integral operations.

Figure 10:
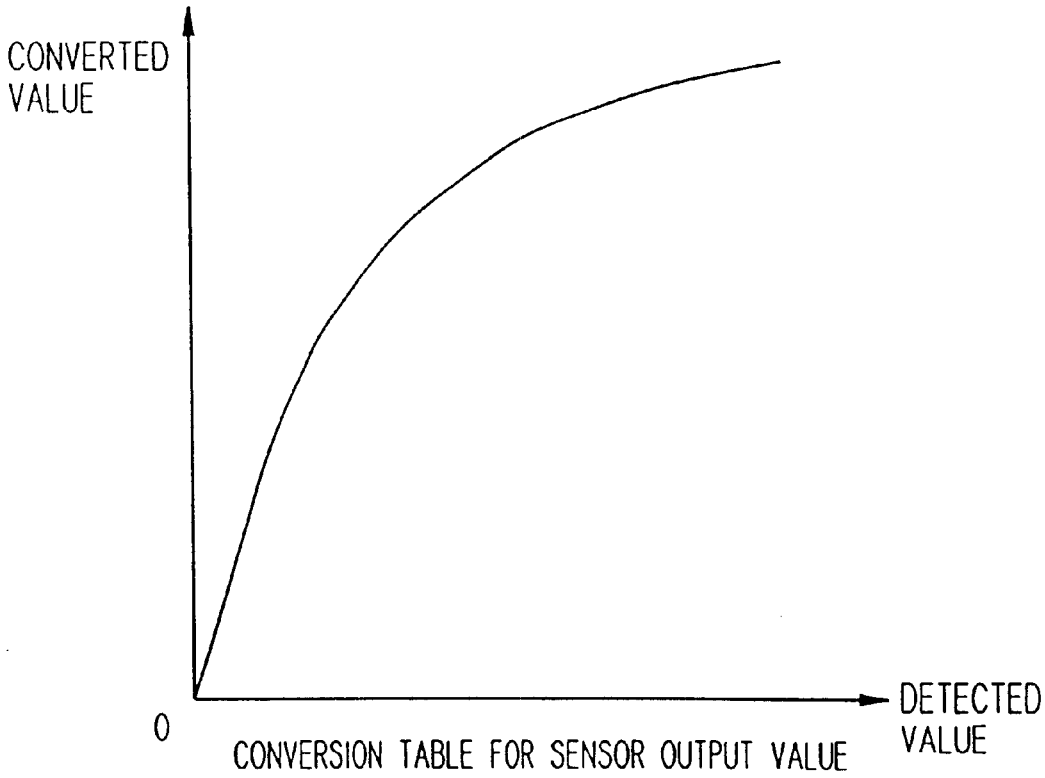
FIG. 10 is an explanatory diagram for a conversion table of sensor output value.

In the above described manner of practice, the values detected by the infrared sensor 30 have been used for arithmetic computations as LED1 output value and LED2 output value without any modification. However, the values detected by the infrared sensor 30 may be converted into conversion values by the use of conversion table for sensor output value as shown in FIG. 10, and then the conversion values may be used in actual arithmetic computations.

In the case where such conversion table for sensor output value is employed, it may be adapted such that a plurality of sensor output value conversion tables each having different characteristics in its conversion curve has been previously set, and an arbitrary sensor output value conversion table can be selected among these sensor output value conversion tables.

In the case of converting a detected value by means of the infrared sensor 30, the value may also be converted through prescribed arithmetic computations without employing any table such as the above described sensor output value converting table.

Furthermore, although the assignment of various kinds of parameters and the setting of parameter values have been made based on both the LED1 output value and LED2 output value in the above described manner of practice, it may be adapted such that the assignment for the type of parameter is effected with LED1 output value and the setting of parameter value is made with LED2 output value, or conversely such that the assignment for the type of parameter is effected with LED2 output value and the setting of parameter value is made with LED1 output value.

Moreover, in the case where parameters are assigned to a control table, although parameters have been switched with respect to the type of parameters based on the absolute values of sensor 1 output value and sensor 2 output value in the above described manner of practice, the manner of switching is not limited thereto. For example, parameters may be switched based on the relative values of sensor 1 output value and sensor 2 output value.

Figure 11:
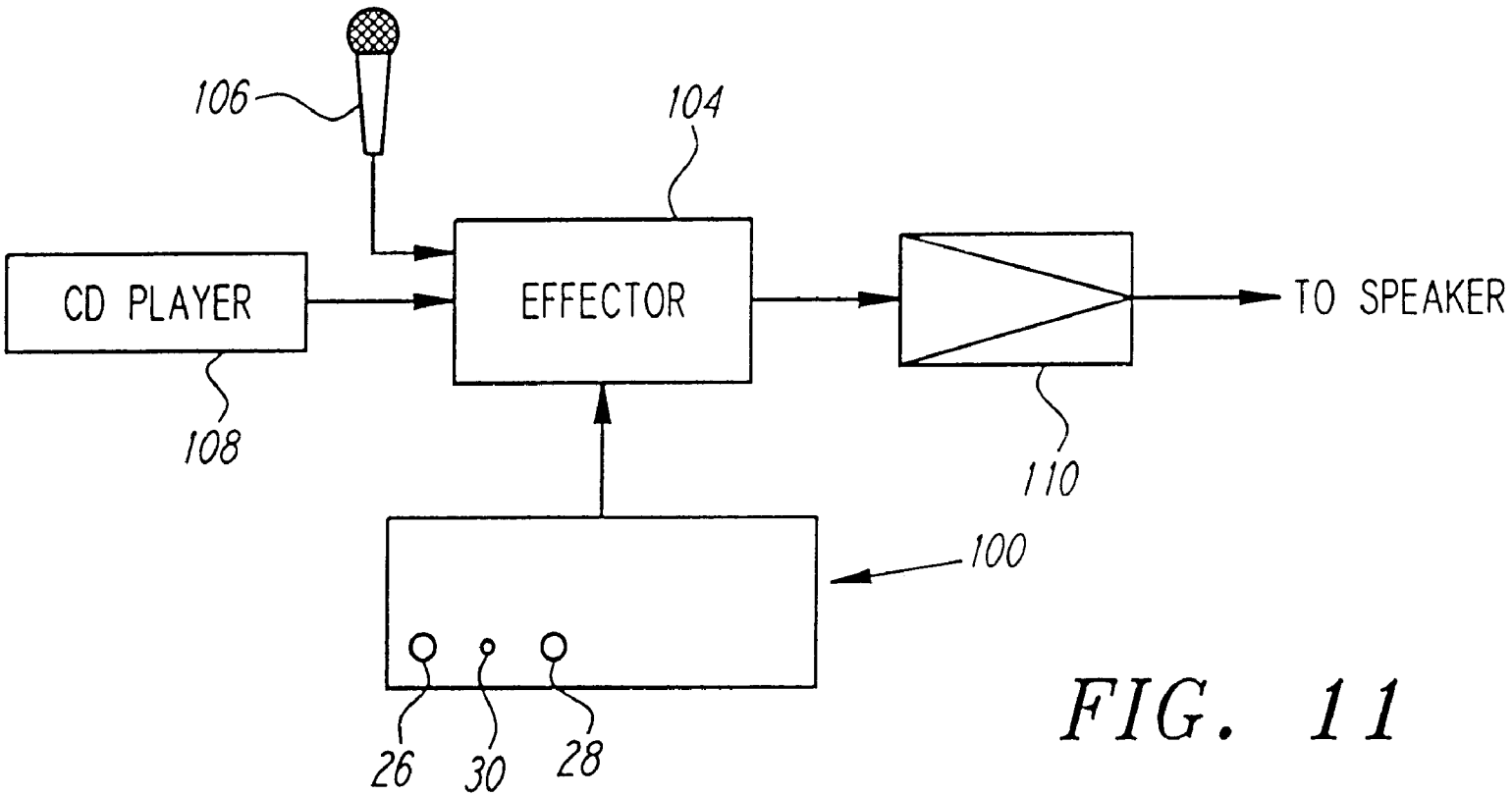
FIG. 11 is an explanatory diagram illustrating an embodiment of the musical apparatus according to the present invention.

Still further, although the above described manner of practice has been explained with respect to the case where the invention is applied to an electronic musical apparatus provided with a sequencer, the invention is not restricted thereto. For example, it may be adapted such that an effector 104 is controlled by a musical apparatus 100 provided with the first infrared LED 26, the second LED 28, and the infrared sensor 30 according to the present invention as shown in FIG. 11 such that an effect is added to an aural signal inputted in real time through a microphone 106 or an aural signal inputted in real time through a CD player 108 in response to control of the musical apparatus 100, and the signal thus effected is outputted to an amplifier 110.

Yet further, while an explanation has been provided about the case where two infrared LEDs (the first infrared LED 26 and the second infrared LED 28) and one infrared sensor 30 are used as the light emitters and the detector, respectively, in the above described manners of practice, the invention is not limited thereto. For example, it may comprise either a single light emitter (i.e., an infrared LED 200) and two light detectors (i.e., a first infrared sensor 202 and a second infrared sensor 204) as shown in FIG. 12, or two light emitters (i.e., a first infrared LED 300 and a second infrared LED 302) as well as two light detectors (i.e., a first infrared sensor 304 and a second infrared sensor 306) as shown in FIG. 13.

Figure 12:
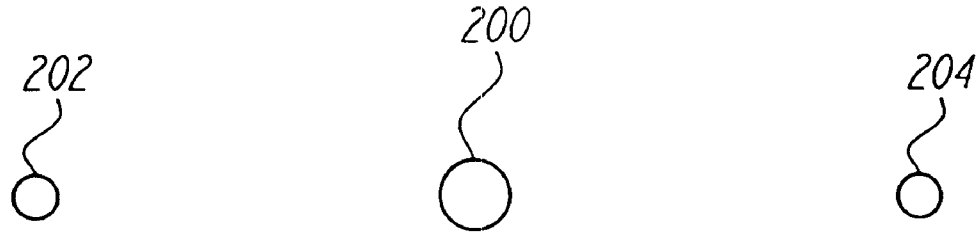
FIG. 12 is an explanatory diagram showing another embodiment with respect to the light emitter and light detector.
Figure 13:
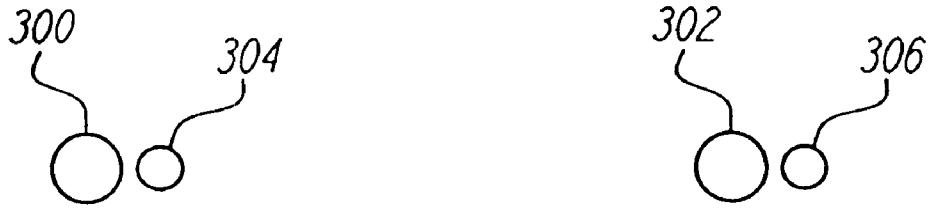
FIG. 13 is an explanatory diagram showing another embodiment with respect to the light emitter and light detection.

In the above described manner of practice shown in FIG. 12, two types of output are obtained from the first infrared sensor 202 and the second infrared sensor 204 as data corresponding to the LED1 output value and the LED2 output value, while two types of output are obtained from the first infrared sensor 304 and the second infrared sensor 306 as data corresponding to the LED1 output value and the LED2 output value in the above described manner of practice shown in FIG. 13. Accordingly, the same processing of the previously described manner of practice can be applied to these two types of output in both the manners of practice shown in FIGS. 12 and 13 respectively.

Moreover, when a hand is held over the sensor 30 and moved upward or downward in the case of assigning parameters to the control table, the types of parameters are successively switched one by one in accordance with a predetermined order. When the hand is held over the infrared sensor 30 and moved rightward or leftward, the types of parameters are switched by larger increments (i.e., not one by one) through a predetermined order in the previously described manner of practice. However, the invention is not restricted thereto, and the following manner of practice is also applicable.

Namely, when a hand is held over the infrared sensor 30 and moved upward or downward immediately over the infrared sensor 30 (a ratio of LED1 output value to LED2 output value is nearly 1 to 1), the types of parameters are successively switched one by one in accordance with a predetermined order, and when the hand is held over the infrared sensor 30 and moved rightward or leftward over the infrared sensor 30 (a ratio of LED1 output value to LED2 output value is not nearly 1 to 1), the last parameter which was switched is assigned and it may be fixed.

Figure 14:
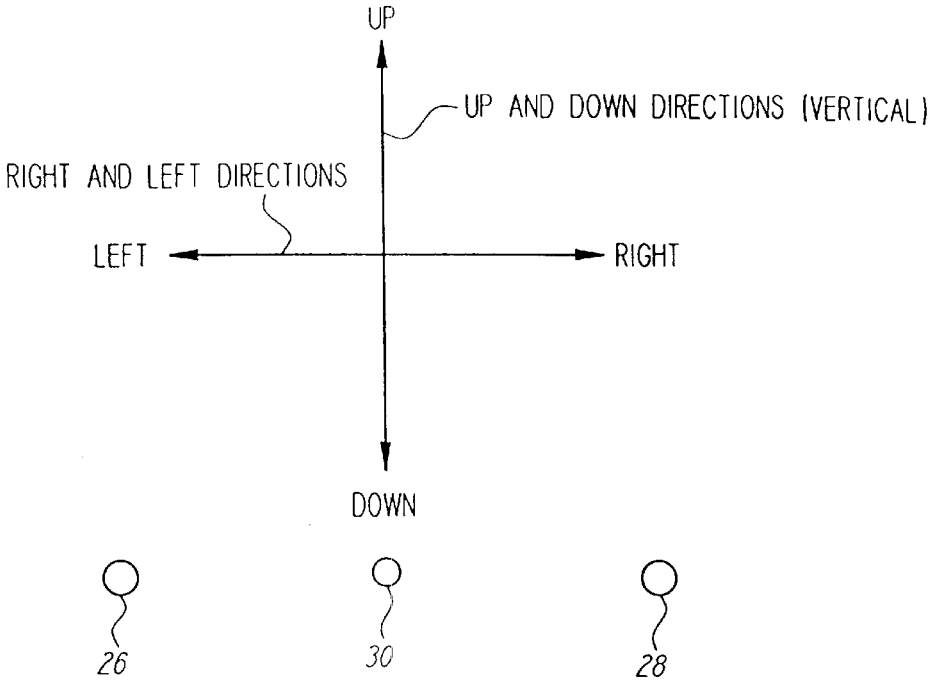
FIG. 14. is an explanatory diagram for explaining the assignment of parameters.

More specifically, when an operator's hand is held over the infrared sensor 30 and moved upward or downward immediately over the infrared sensor 30 as shown in FIG. 14, a relationship "LED1 output value: LED2 output value=1:1" is almost maintained, and parameters are switched in response to a total value of the LED1 output value and the LED2 output value in the case where the relationship "LED1 output value: LED2 output value=1:1" is maintained. On the other hand, when the operator's hand is held over the infrared sensor 30 and moved rightward or leftward over the infrared sensor 30, a relationship "LED1 output value: LED2 output value≠1:1" is obtained, so the last parameter which was switched is fixed to be assigned when the relationship "LED1 output value: LED2 output value≠1:1" is established.

Furthermore, as a manner for assigning a parameter instructing switching for phrase performance data, the following example manner may be adopted.

Figure 15:
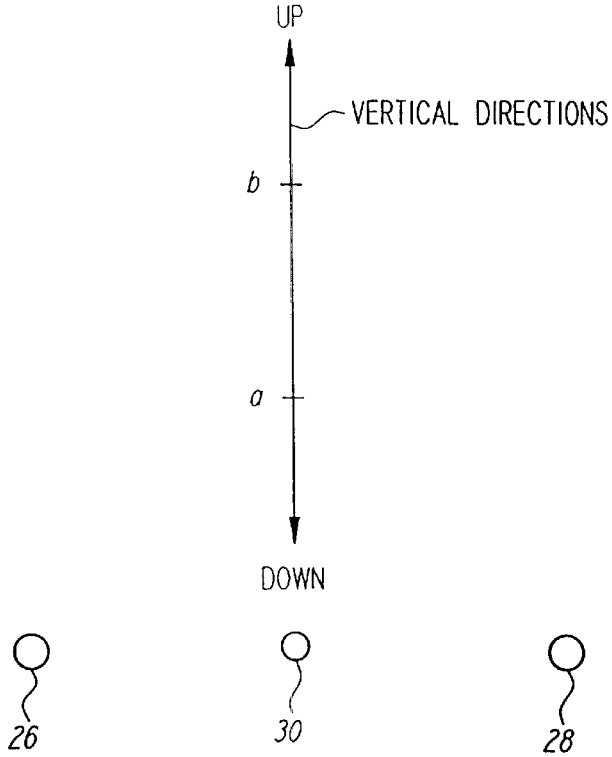
FIG. 15 is an explanatory diagram for explaining the assignment of parameters.

Namely, when a hand is held over the infrared sensor 30 and moved upward or downward immediately over the infrared sensor 30 as shown in FIG. 15, a relationship "LED1 output value: LED2 output value=1:1" is nearly maintained, and in the case when the relationship "LED1 output value: LED2 output value=1:1" is maintained and further, the hand is held between the positions a and b (in case of a<LED1 output value<b and a<LED2 output value<b), it may be adapted to be switched to, for example, the first phrase performance data.

Figure 16A:
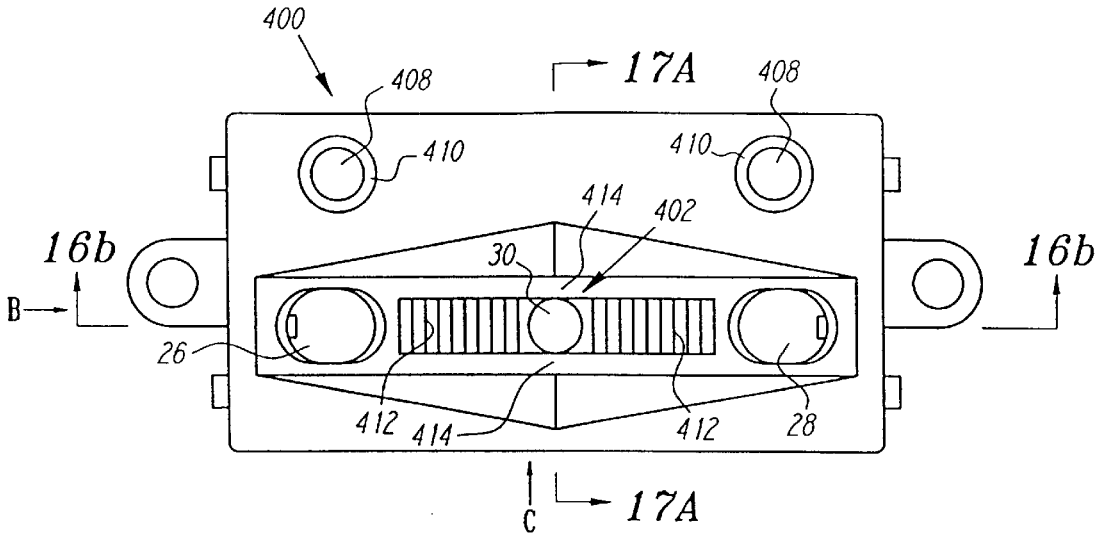
FIGS. 16(*a*), (*b*), and (*c*) are explanatory diagrams each showing a casing wherein (*a*) is a top view, (*b*) is a sectional view taken along the line 16*b*—16*b* of (*a*), and (*c*) is a view taken in the direction of the arrow C in (*b*)
Figure 16B:
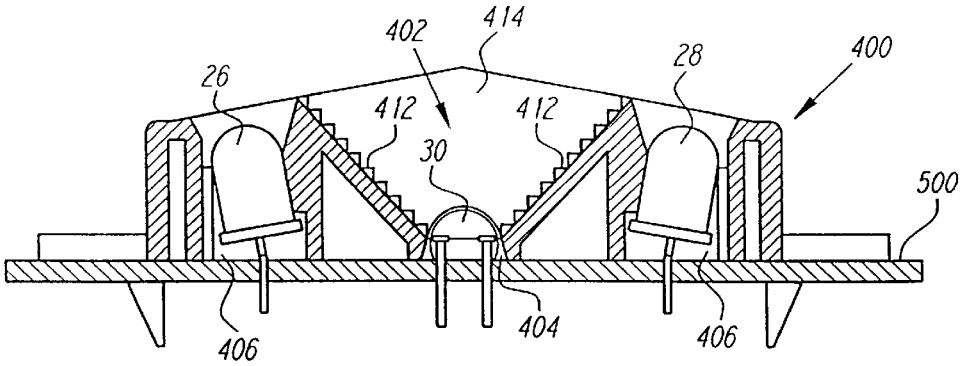
Figure 16C:
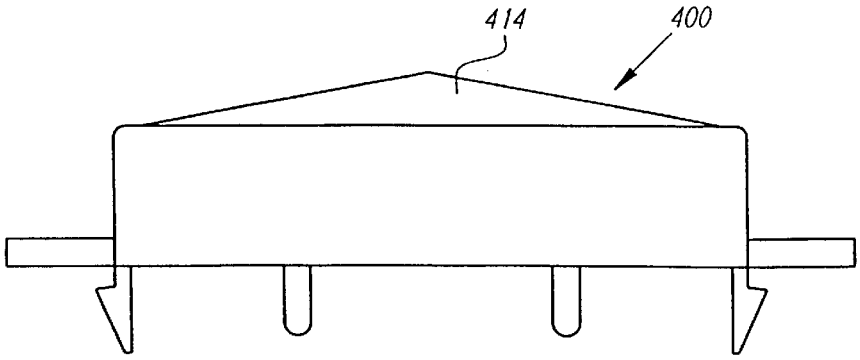
Figure 17A:
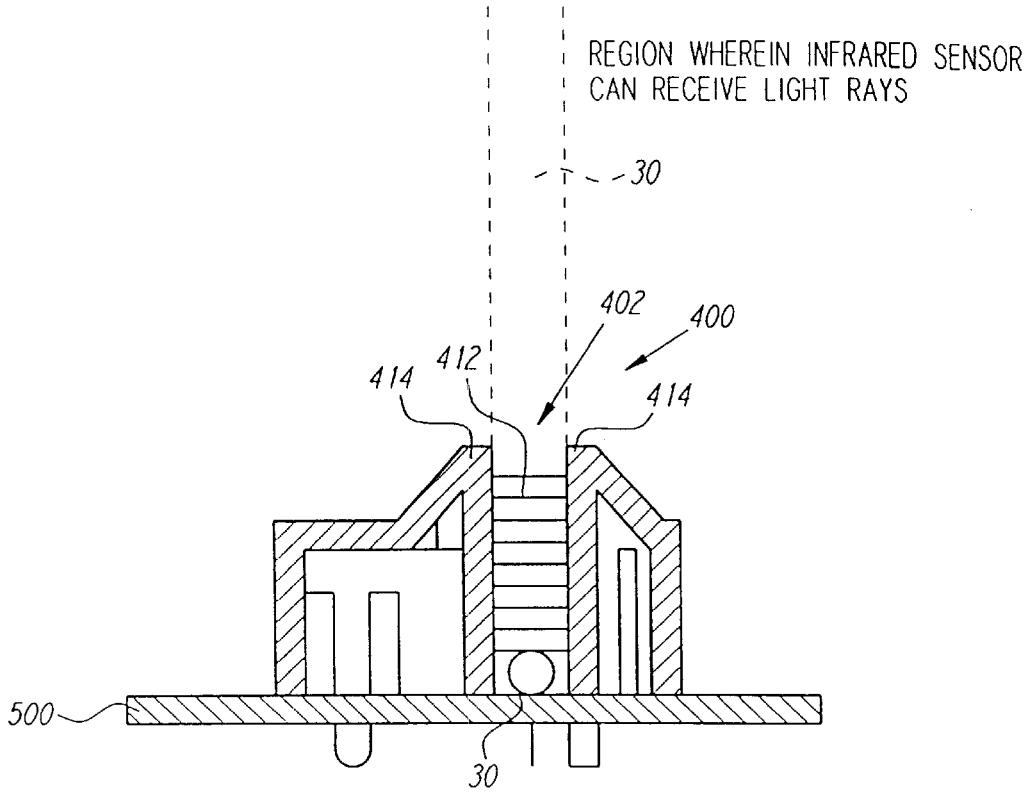
FIGS. 17(*a*) and (*b*) are explanatory diagrams each showing a casing wherein (*a*) is a sectional view taken along the line 17A—17A of FIG. 16(*a*), and (*b*) is a view taken in the direction of the arrow B in FIG. 16(*a*)
Figure 17B:
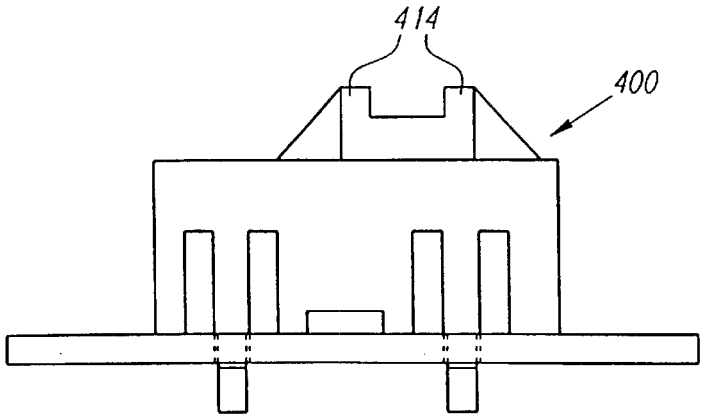

In an embodiment of the present invention, the first infrared LED 26, the second infrared LED 28, and the infrared sensor 30 may be mounted on a casing 400 shown in FIGS. 16 and 17.

The black casing 400 which is attached to a base plate 500 is made of a resin having an opened port 402, which is defined such that the port widens upwardly and narrows downwardly with respect to the horizontal direction in FIG. 16(*a*), and an infrared sensor hole 404 for inserting the infrared sensor 30 defined at the center of the opened port 402 where an infrared sensor 30 is disposed in the infrared sensor hole 404.

Moreover, a pair of infrared LED holes 406 to contain the first-infrared LED 26 and the second infrared LED 28 are defined at the right and left positions respectively with respect to the opened port 400, and the first infrared LED 26 and the second infrared LED 28 are disposed in each of the infrared LED holes 406 in an outwardly inclined manner.

The reason for providing the first LED 26 and the second LED 28 in an outwardly inclined manner is reduce the size of the casing 400 as compared to the case where the first infrared LED 26 is simply apart from the second LED 28 and disposed along the same direction with each other.

In the vicinity of the first infrared LED 26 and the second infrared LED 28, display LED holes 410 for containing display LEDs 408 corresponding to the first infrared LED 26 and the second infrared LED 28, respectively, are defined, and the display LEDs 408 are placed in the display LED holes 410 respectively.

Furthermore, steps 412 are formed in the opened port 402, and these steps 412 function for preventing diffused reflection. More specifically, since the casing 400 is black, infrared radiation is absorbed by the steps 412, but even in this situation, the diffused reflection is not a small quantity, so that steps 412 are provided for preventing the input of infrared radiation which is diffusively reflected to the infrared sensor 30.

Figure 18:
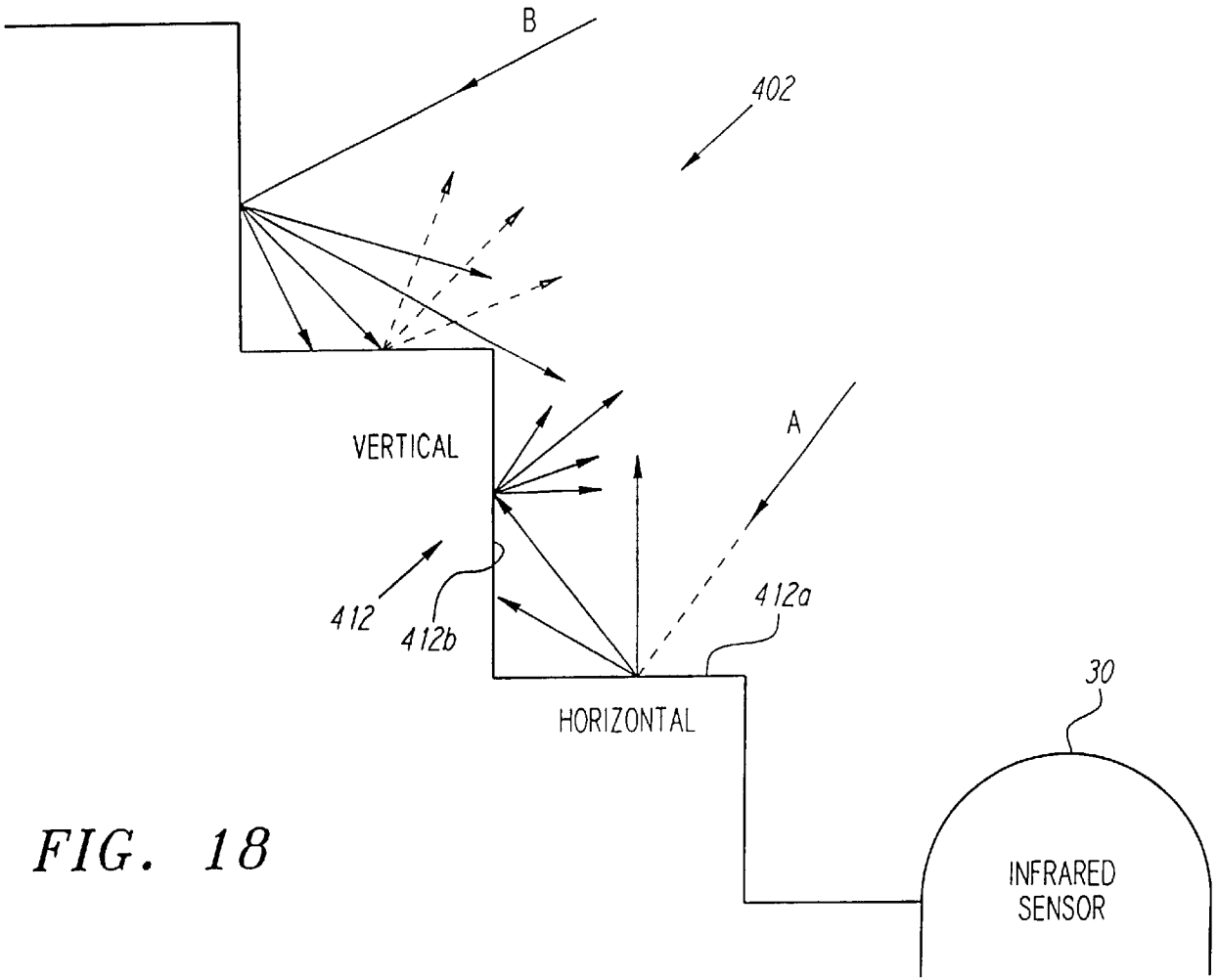
FIG. 18 is an explanatory diagram showing an enlarged opened port of the casing.

FIG. 18 is an explanatory view showing the enlarged opened port 402 defined on the casing 400 wherein infrared radiation which is inputted is indicated by arrow A, and first runs against a horizontal section 412*a* of a step 412 and is reflected diffusively toward upper direction without reaching the infrared sensor 30. Even if a portion of the infrared radiation which was diffusively reflected in an upper direction from a horizontal portion 412*a*, it runs against a vertical section 412*b* of a step 412 thereafter and is radiated into space without reaching the infrared sensor 30.

Furthermore, although infrared radiation as inputted as indicated by arrow B first runs against the vertical section 412*b* of a step 412 and is reflected diffusively toward the direction of the infrared sensor 30, most of the infrared radiation which has been reflected diffusively toward the direction of the infrared sensor 30 runs against the horizontal section 412*a* of a step 412 thereafter, whereby it is reflected diffusively toward the upper direction without reaching the infrared sensor 30, and it is radiated into space. Thus, when the steps 412 are formed in the opened port 402 of the casing 400, interference due to diffusion reflection of infrared radiation can be remarkably reduced.

Further, in FIG. 16(*a*), mountain-like shaped wall portions 414 are disposed on the base plate in such a way that they face each other with the opened port 402 located in-between and they project perpendicularly from the plane of FIG. 16(*a*), whereby the reflected light of infrared rays radiated from the first infrared LED 26 and the second infrared LED 28 is restricted by these wall portions 414 along the upper and lower directions in FIG. 16(*a*) within a region wherein the infrared sensor 30 can receive such reflected light (see FIG. 17(*a*)).

In other words, if the wall portions 414 are not provided, for example, when an operator's hand moves upward and downward in FIG. 16(*a*), all of the situations wherein an area by which reflected infrared radiation increases successively in a manner such that "a situation wherein infrared radiation is reflected only by hand→a situation wherein infrared radiation is reflected by hand and wrist→a situation wherein infrared radiation is reflected by hand, wrist, and arm" are detected by the infrared sensor 30, and as a result, a correct position of the hand or the arm cannot be detected.

In this respect, since a light-receivable region by the infrared sensor 30 is limited in the casing 400 as described above, when an operator's hand or arm moves upward and downward in FIG. 16(*a*), an area of reflection region wherein infrared radiation is reflected in the light-receivable region of the infrared sensor 30 becomes substantially uniform, so that the position of hand or arm can be correctly detected to realize suitable control for musical tone.

In the present invention, if one light emitter and a plurality of light detectors are mounted on, for example, the above described casing 400, it may be adapted such that an infrared LED is disposed in an infrared sensor hole 404 and infrared sensors are disposed in a plurality of infrared LED holes 406, respectively.

It is to be noted herein that the above described pair of display LEDs 408 are two-color LEDs of red and green colors, so that a variety of display manners are realized in accordance with various modes. Namely, the manner of display is represented by, for example, the following paragraphs (a) to (f), respectively.

(a) When the reflected light of infrared radiation by a material object is detected, the display LEDs are lit and the luminance thereof changes in response to the distance (level of the infrared rays reached after reflection).

(b) When the reflected light of infrared radiation by a material object is detected, the display LEDs flash and the flashing cycle changes in response to the distance (level of the infrared rays reached after reflection).

(c) When the reflected light of infrared radiation by a material object is detected, the display LEDs flash and the flashing pattern changes in response to the distance (level of the infrared rays reached after reflection).

(d) When the reflected light of infrared radiation by a material object is detected, the display LEDs are lit and both the display LEDs 408 flash in the case where the values corresponding to the first infrared LED 26 and the second infrared LED 28 coincide with each other.

(e) In response to a distance (level of the infrared rays reached after reflection), the color (red-green-orange) of the display LED 408 changes.

(f) In response to a distance (level of the infrared rays reached after reflection), the pattern for light-emitting order of colors (red-green-orange) of the display LED 408 changes. For instance, it is arranged such that "red→green→orange→red" represents a long distance (level of the infrared rays reached after reflection), and "red→green→red→orange" represents a short distance (level of the infrared rays reached after reflection).

In the above described cases (a), (b), (c), and (d), the display LEDs may be lit in different colors in response to the type of parameter to be controlled. For instance, the display LED is lit in red color in the case of controlling cut-off by the use of a value of the first infrared LED 26.

Furthermore, a display LED may be lit in different colors depending on the category of parameters such that, for example, the display LED emits red light when controlling parameters in a filter system, orange light when controlling parameters in an amplifier system, and green light when controlling parameters in a LFO system.

Moreover, in the above described cases (a), (b), (c) and (d), the display LED may be adapted to display the same by changing its lighting state based on whether the apparatus is recording or reproducing, or based on modes of the sequencer 18. For instance, the display LED can emit green light during reproducing, red light during recording, and orange light during a setting mode when parameters are being set.

In addition, a display LED may be adapted such that when a value of a parameter approaches a predetermined value (for example, a value as to condition set in the column of condition of "CONDITIONALLY CONTROLLED OBJECT" in the above described manner of practice), the manner of display of the display LED changes as in the above described cases (a) to (f).

Figure 19A:
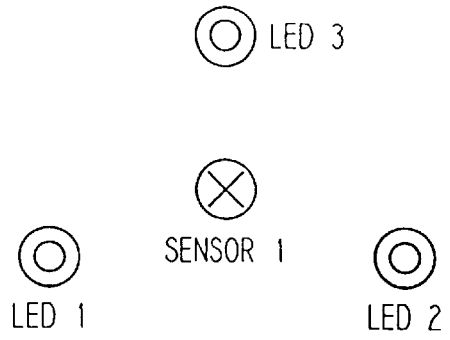
FIGS. 19(*a*), (*b*), and (*c*) are diagrams each showing an example wherein three infrared LEDs are used as light emitters wherein (*a*) is an example employing three infrared LEDs and one infrared sensor, (*b*) is an example employing three infrared LEDs and two infrared sensors, and (*c*) is an example employing three infrared LEDs and two infrared sensors.
Figure 19B:
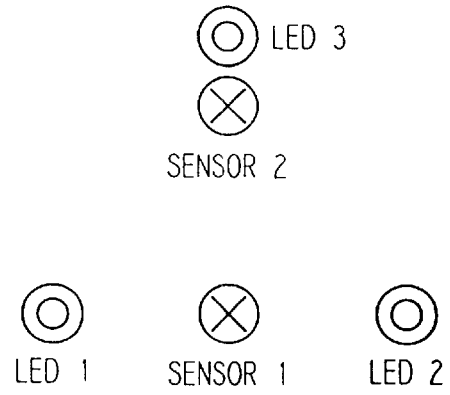
Figure 19C:
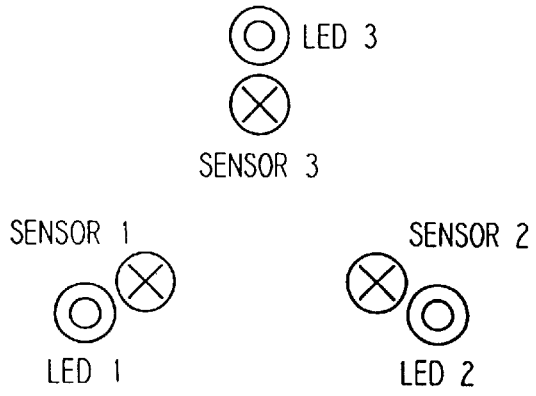

FIGS. 19(*a*), (*b*), and (*c*) show examples wherein three infrared LEDs are used as light emitters respectively.

The example shown in FIG. 19(*a*) contains three infrared LEDs (LED1, LED2, and LED3) and one infrared sensor (sensor 1) wherein these three LEDs (LED1, LED2, and LED3) are lit in a time-sharing manner, the output values of the LEDs are detected, and they are shut off, whereby the position, movement, and speed of movement of a material object which reflects infrared radiation in the depth direction thereof can be detected in addition to the detection of positions, movement, and speed of movement of the material object in vertical and horizontal directions.

It is to be noted that a player's hand is typically the material object which reflects infrared radiation. When a hand moves in a depth direction, a reflection area reflecting infrared radiation increases, so that LED output values increase with respect to respective infrared LEDs (LED1, LED2, and LED3).

For instance, first, a hand is held at a predetermined height and at an intermediate position between the LED1 and the LED2, and then, when the hand moves in a depth direction, the reflection area reflecting infrared radiation increases, so that the LED1 output value, the LED2 output value, and the LED3 output value all increase. Thus, when detection in upward and downward directions is conducted with the LED1 output value and the LED2 output value as in the above described manners of practice, an erroneous detection that "the material object also moves downward while moving toward depth direction" occurs despite the fact that the material object is allowed to move in a depth direction at a constant height.

In this respect, the example shown in FIG. 19(*a*) is adapted such that a conversion table indicates that the position in space of a hand or arm, i.e., the coordinates (x, y, z) on XYZ coordinate axes, the LED1 output value, the LED2 output value, and the LED3 output value take how much level of values has been previously stored in the ROM 14 (the coordinates in space are determined from three LED output values LED1 output value, LED2 output value, and LED3 output value), whereby the position, movement, and speed of movement of the hand or the arm are calculated.

FIG. 20 shows an example of such a conversion table wherein it is desirable that three types of conversion table, i.e., a conversion table used for an ordinary adult male hand, one used for an ordinary adult female hand, and one used for a child's hand have been stored in the ROM 14, and the desired conversion table can be selected by an operator.

The example shown in FIG. 19(*b*) employs three infrared LEDs (LED1, LED2, and LED3) as in the example shown in FIG. 19(*a*), but it differs from the example of FIG. 19(*a*) in that two infrared sensors (sensor 1 and sensor 2) are used as light detectors.

The example shown in FIG. 19(*b*) is the same as that of FIG. 19(*a*) in that three LED1, LED2, and LED3 are lit in a time-sharing manner, LED output values are detected, and the emission of the LEDs are shut-off, but the former is constituted such that sensor 2 is disposed in the vicinity of LED3. That is, the light emission from one infrared LED is received by two infrared sensors. Accordingly, the example in FIG. 19(*b*) may perform more precise detection as compared to that of FIG. 19(*a*).

Furthermore, the example shown in FIG. 19(*c*) employs three infrared LEDs (LED1, LED2, and LED3) as in the examples shown in FIGS. 19(*a*) and (*b*), but it differs from these examples of FIGS. 19(*a*) and (*b*) in that three infrared sensors (sensor 1, sensor 2, and sensor 3) are used as light detectors.

The example shown in FIG. 19(*c*) is the same as those of FIGS. 19(*a*) and (*b*) in that three LED1, LED2, and LED3 are lit in a time-sharing manner, LED output values are detected, and lighting of the LEDs are shut off, but the former is constituted such that infrared sensors are disposed in the vicinity of the respective infrared LEDs. Accordingly, when a conversion table as described in FIG. 20 (values of coordinates differ from that of FIG. 19(*a*)) is employed, the position of a certain level can be detected with respect to the light emission of one infrared LED.

In this respect, in the example shown in FIG. 19(*c*), light is emitted from LED1 to determine the coordinates in space, then light is emitted, similarly from LED2 to determine the coordinates in space, and light is emitted from LED3 to determine the coordinates in space. Hence, the three coordinates thus determined are averaged to determine new coordinates, whereby musical tones can be controlled on the basis of the new coordinates thus determined. As a result, according to the example shown in FIG. 19(*c*), it becomes possible to detect the position, movement, and speed of movement of a material object with remarkably high precision.

While it has been arranged such that LED output values are permitted to output essentially with respect to the light emission from one infrared LED in the above described manners of practice, the invention is not limited thereto. Instead, light emission may be made from a plurality of infrared LEDs in a time-sharing manner. In this respect when this patent application explains, for example, the example shown in FIG. 19(*a*), the following manners may be also applied to detect positions in space:

(1) Simultaneous lighting of LED1 and LED2→simultaneous shutting off of LED1 and LED2→detection of output values of LED1 and LED2;

(2) Simultaneous lighting of LED2 and LED3→simultaneous shutting off of LED2 and LED3→detection of output values of LED2 and LED3;

(3) Simultaneous lighting of LED3 and LED1→simultaneous shutting off of LED3 and LED1→detection of output values of LED3 and LED1.

Moreover, it may be adapted to combine LED1 output value, LED2 output value, and LED3 output value with one another.

Those of ordinary skill in the art will appreciate that the present invention is not limited to the specific examples described above and can embody other specific implementations and modifications without departing from the spirit or essential characteristics thereof, including but not limited to the following examples.

It does not matter what the light source is as long as the light source radiates light. The light source is not limited to radiating non-visible light such as infrared light, but may radiate visible light. A light source may employ one or more light generating devices such as, for example, infrared light emitting diodes (infrared LEDs) and, in those cases which use a plurality of light sources, it may be sufficient to implement, for example, two infrared LEDs.

Similarly, it does not matter what the light detector is as long as it detects light. Further, the light detector is not limited to detecting non-visible light such as infrared light, and it may detect visible light. A light detector may employ one or more light receiving devices such as, for example, infrared sensors and, in those cases which use a plurality of light detectors, it may be sufficient to implement, for example, two infrared sensors.

The light sources and light detectors may be implemented such that at least two of said reflected light beams can be detected. For example, the system is equipped with a plurality of light sources which generate light, the timing of each of which is mutually different from one another, and one light detector, and by obtaining the results of the detection for the light detector that corresponds to the timing of the generation of light in the same period, it is possible to detect separately each light beam in a plurality of reflected light beams. The reference herein to "light beam" includes light rays which travel through space, but is not intended to require any concentration of light. In this case, for a multiple number of light sources, they may be arranged at a specified interval (see e.g., FIG. 2) or it may be arranged such that the irradiation directions of the light beams from the light sources are different (see e.g., FIG. 16). When the positions of the objects in the space are changed, the detection state of the light reflected by the object changes.

Alternatively, the system is equipped with a single light source and a plurality of light detectors and by using the detection results of each of the light detectors, it is possible to detect a plurality of reflected light beams (see e.g., FIG. 12). In this case, there may be an arrangement in which, for example, a specified interval is instituted for the multiple number of light detectors, or it may be arranged such that the orientational properties of the detection regions are different. When the positions of the objects in the space are changed, the detection state of the light reflected by the relevant object changes. In another embodiment, a single light source and a single light detector that detects the reflected light derived from the irradiated light from this light source are assembled and a plurality of this assembly are provided at specified intervals, it is possible to detect a plurality of reflected light beams (see e.g., FIG. 13). When the positions of the objects in the space change, the detection state of the light reflected by the relevant object changes.

As another example, it is sufficient for a musical tone controller to control a musical tone signal generator. For example, the musical tone controller may control the characteristics of the musical tone such as the volume of the musical tone signal that is produced by the musical tone signal generator during the performance, or the musical tone signal phrase produced by the musical tone signal generator may be switched to a specified phrase. Alternatively, the musical tone controller may be implemented with various kinds of settings of the musical tone signal generator at times other than during the performance.

As still another example, the musical apparatus embodying the present invention may apply a variety of musical tone control modes other than the musical tone control mode described above. For example, the "SOURCE" column of the control table may specify that the output value is the greater of LED 1 output value and LED 2 output value. As another example, it was previously described that LED 1 output value and LED 2 output value are judged to be nearly the same if the ratio between LED 1 output value and LED 2 output value is roughly 1 to 1. However, for example, LED 1 output value and LED 2 output value may be deemed to be nearly the same if the absolute value of the difference between LED 1 output value and LED 2 output value is less than a specified value.

An example of this musical tone control mode is shown in FIG. 21. The "SOURCE" column of the control table establishes that the output value is the greater of LED 1 output value and LED 2 output value. The "CONDITION" column that corresponds to this "SOURCE" column establishes the condition that the absolute value of the difference between LED 1 output value and LED 2 output value is less than 5 and, moreover, the value of the output value that is the greater of LED 1 output value and LED 2 output value is within a specified range (for example, greater than 10 but less than 20). By doing it in this manner, under the condition that LED 1 output value and LED 2 output value are nearly the same, the control of the sequencer 18 and the sound source 20 is carried out based on the output value that is the greater of LED 1 output value and LED 2 output value. It is also possible to control the pitch of the musical tone signal that is produced by the sound source 20 based on the output value that is the, greater of LED 1 output value and LED 2 output value and to select the phrase performance data that is output from the sequencer 18.

As yet another example, the "CONDITION" column of the control table establishes that the absolute value of the difference between LED 1 output value and LED 2 output value is less than a specified value and moreover, the total value of LED 1 output value and LED 2 output value is within a specified range. When this condition is satisfied, control of the sequencer 18 and the sound source 20 may be based on the total value of LED 1 output value and LED 2 output value. An example of this kind of setting is shown in FIG. 21. In those cases where the absolute value of the difference between LED 1 output value and LED 2 output value is less than 5 and, moreover, the total value of LED 1 output value and LED 2 output value is greater than 50, control of the volume of the musical tone signal that is produced by the sound source is based on the total value of LED 1 output value and LED 2 output value.

As yet another example, the "CONDITION" column of the control table may set the range condition that LED 1 output value is within and the range condition that LED 2 output value is within and together with this, the control of the sequencer 18 and the sound source 20 is based on the total value of LED 1 output value and LED 2 output value when these conditions are satisfied. An example of this kind of setting is shown in FIG. 21. In the setting example shown in FIG. 21, in those cases where each of LED 1 output value and LED 2 output value falls within its respective corresponding range, the cutoff of the musical tone signal that is produced by the sound source 20 is controlled based on the total value of LED 1 output value and LED 2 output value.

Additionally, it has been previously explained with respect to the musical tone generator, that phrase performance data expresses the phrase stored in advance in the sound source 20 and the production of the musical tone signal is based on the phrase performance data that have been read out. However, any musical tone signal generator may be employed as long as it can produce a musical tone. For example, in one embodiment, a plurality of musical tone waveform data which express phrases respectively are previously stored in the musical tone generator, one of the musical tone waveform data is selected by the phrase performance data, and the musical tone generator produces a musical tone signal by reading the selected musical tone waveform data. However, the implementation may include a performance operation element such as a keyboard and a keypad as shown in FIG. 1, generating performance data from the performance operation element in response to the operation by the user, and generating the musical tone signal in accordance with this performance data. Further, it is possible to have a musical tone signal generator equipped with a performance data input terminal to which performance data such as MIDI signals are input from an external device and the production of the musical tone signal is based on the performance data that are input from the performance data input terminal.

In those cases where the musical tone signal is generated by reading the musical tone waveform data, it is possible to modify the implementation such that, under the condition where the detected value of the reflected light satisfies a specified condition, a specified musical tone waveform data that was set in advance is read out. For example, the musical tone waveform data that express the phrase A is assigned to the range for the output value of the LED in which "a<LED output value<b" and the musical tone waveform data that expresses the phrase B is assigned to the range for the output value of the LED in which "b<=LED output value." Further, under the condition where the absolute value of the difference between the output value of the LED 1 and the output value of the LED 2 is less than a specified value, when the LED output value that is the greater of either the output value of the LED 1, or the output value of the LED 2 falls within either of the ranges discussed above, the musical tone waveform data for the phrase to which that range has been assigned can be selected and read out.

In those cases where musical tone generation is accomplished in this manner, after the user's hand is held in a high position directly above the infrared sensor 30 and then gradually lowered, the read-out of the musical tone waveform data for phrase A is carried out when LED output value becomes greater than a. As the playing continues and the hand is lowered further, the read-out of the musical tone waveform data for phrase B is carried out instead of the one for the phrase A when the LED output value becomes b or greater. Incidentally, in this case, when the LED output value has fallen below a, the read-out of the musical tone waveform data terminates because the musical tone waveform data that correspond to that LED output value does not exist. Further, because this implementation reads out the musical tone waveform data under the condition that the absolute value of the difference between the output value of the LED 1 and the output value of the LED 2 is less than a specified value, there is no read-out of any of the musical tone waveform data when the hand is held in a position other than directly above the infrared sensor, and it is possible to carry out the read-out of the musical tone waveform data only in those cases where read-out is intentional. In addition to reading out musical tone waveform data when the hand is held in a high position directly above the infrared sensor 30 and gradually lowered; a performance method is also possible in which the hand is held in a position diagonally above the infrared sensor 30 and, when the hand is gradually shifted to directly above the infrared sensor 30, the read-out of the musical tone waveform data for a specified phrase is carried out. This kind of performance cannot be carried out in those cases where only one LED output value is used, and requires the use of a plurality of LED output values.

In addition, the musical tone signal generator may be configured with specially designed hardware, or a processing system such as a CPU or a DSP (digital sound processor) and a processing program that is executed by the processing system. Similarly, the computing logic and the musical tone controller may be configured by specially designed hardware, or by a processing system such as a CPU or a DSP and a processing program that is executed by the processing system.

As another example, the control table may be implemented to allow the performer to rewrite the contents of the control table as desired. However, the control table may also be implemented such that the stored contents are fixed or permanent and predetermined such that they cannot be rewritten at will by the user.

Moreover, as described above, all of the stored contents of the control table are always in effect. However, the musical apparatus may be implemented such that it is possible to select which of the stored contents of the control table are to be effective. For example, in those cases where sources can be assigned to a plurality of control objects such as "assignment 1," "assignment 2, etc.", one can select which one or ones of the control objects is to be effective. Further, there may be a plurality of control tables where one can select any of the control tables for use at will.

Although the present invention covers still further examples which are apparent to one of skill in the art, a last illustrative example is provided here. This example relates to the satisfaction or nonsatisfaction of conditions. There are numerous ways to judge whether the conditions that have been set in advance for the LED output values have been satisfied. For instance, a condition satisfaction logic may determine whether the LED output value satisfies a condition by comparing the computation of the LED output value with the value of the condition that has been set in advance. The condition satisfaction logic may comprise, for example, software and hardware. Alternatively, one may use the storage region corresponding to all of the values that are derived from the LED output values such that data indicating the satisfaction of the condition are stored in the storage region which corresponds to the LED output values that satisfied the condition. Together with this, data indicating that the condition has not been satisfied are stored in the storage region that corresponds to the LED output values that do not satisfy the condition. In this manner, a table is created where the determination of whether the LED output value satisfies the condition is made by reference to this table based on the LED output value.

While the invention has been illustrated and described in detail above, it is not intended to be limited to the specific details discussed because various modifications, additions and changes may be made without departing in any way from the spirit of the present invention. The presently disclosed embodiments are therefore considered in all respects to be illustrative and not restrictive.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to fall within the meaning and range of equivalents of the following claims.

What is claimed is:

1. An electronic sound generating system which responds to the motion of an object in a space exterior to the electronic musical system in order to control a sound function, the system comprising:

at least one radiation source that emits radiation into a space outside the electronic sound generating system where the emitted radiation hits an object in the space;

at least one detector that detects radiation reflected along at least two paths from the object in the space outside the electronic sound generating system to detect motions of the object;

a controller for generating a control signal for controlling the sound function dependent on the motions of the object; and a tone generator for generating a sound that is at least partially dependent upon the sound function.

2. The system of claim 1, wherein the radiation source that emits radiation comprises a light source that emits at least one light beam and wherein the detector that detects radiation comprises a light detector that detects light reflected along at least two paths from the object.

3. The system of claim 1, wherein the sound function is an audio signal.

4. The system of claim 1, Wherein the sound function is a tone signal.

5. The system of claim 1, wherein the sound function is an electronic audio control signal.

6. The system of claim 5, wherein the electronic audio control signal comprises a MIDI signal.

7. An electronic audio control system which responds to the motion of an object in a space exterior to the electronic musical system in order to control a sound function, the system comprising:

at least one radiation source that emits radiation into a space outside the electronic musical system where the emitted radiation hits an object moving in the space;

at least one detector that detects radiation reflected from the object in the space outside die electronic audio control system and produces at least two detection values therefrom, the detection values being dependent upon the motion of the object; and a controller for generating a control signal for controlling the sound function dependent on the motions of the object.

8. The system of claim 7, wherein the radiation source that emits radiation comprises a light source that emits at least one light beam and wherein the detector that detects radiation comprises a light detector that detects light reflected along at least one path from the object.

9. The system of claim 7, wherein the sound function is an audio signal.

10. The system of claim 7, wherein the sound function is a tone signal.

11. The system of claim 7, wherein the sound function is an electronic audio control signal.

12. The system of claim 11, wherein the electronic audio control signal comprises a MIDI signal.

* * * * *